US009286832B2

(12) United States Patent
Park et al.

(10) Patent No.: US 9,286,832 B2
(45) Date of Patent: Mar. 15, 2016

(54) ORGANIC LIGHT-EMITTING DISPLAY

(71) Applicant: Samsung Display Co., Ltd., Yongin, Gyeonggi-do (KR)

(72) Inventors: Kyoung-Tae Park, Yongin (KR); Dong-Yoon So, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/491,893

(22) Filed: Sep. 19, 2014

(65) Prior Publication Data

US 2015/0294618 A1 Oct. 15, 2015

(30) Foreign Application Priority Data

Apr. 9, 2014 (KR) ..... 10-2014-0042535

(51) Int. Cl.
*G09G 5/00* (2006.01)
*G09G 3/32* (2006.01)

(52) U.S. Cl.
CPC ..... *G09G 3/3233* (2013.01); *G09G 3/3291* (2013.01); *G09G 2300/0413* (2013.01); *G09G 2300/0439* (2013.01); *G09G 2320/0233* (2013.01); *G09G 2320/043* (2013.01)

(58) Field of Classification Search
CPC . G09G 3/3233; G09G 3/3241; G09G 3/3258; G09G 3/3291; G09G 2300/0413; G09G 2320/046; G09G 2330/08; G09G 2330/10
See application file for complete search history.

(56) References Cited

U.S. PATENT DOCUMENTS 5,729,309 A * 3/1998 Na ..... G02F 1/1309 349/192
6,111,558 A * 8/2000 Jeung ..... G02F 1/136259 345/204
6,380,992 B1 * 4/2002 Lee ..... G02F 1/1309 349/152
6,943,374 B1 * 9/2005 Park ..... G02F 1/1309 257/347
2008/0036386 A1 * 2/2008 Shin ..... G09G 3/3225 315/169.3
2010/0207106 A1 * 8/2010 Lhee ..... H01L 27/3244 257/40
2011/0032442 A1 * 2/2011 van Aerle ..... G02F 1/136259 349/38
2012/0092306 A1 * 4/2012 Liu ..... G09G 3/20 345/204
2012/0299887 A1 * 11/2012 Tanaka ..... G09G 3/3688 345/204
2013/0201172 A1 8/2013 Jeong et al.
(Continued)

FOREIGN PATENT DOCUMENTS

KR 10-0666639 B1 1/2007
KR 10-2013-0091136 A 8/2013
KR 10-2013-0136187 A 12/2013

*Primary Examiner* — Joe H Cheng
(74) *Attorney, Agent, or Firm* — Lewis Roca Rothgerber Christie LLP

(57) ABSTRACT

An organic light-emitting display apparatus includes pixels at an active area, dummy pixels at a dummy area, and repair lines coupled to the plurality of dummy pixels and connectable with the plurality of pixels. Each of the plurality of dummy pixels includes: an output node coupled to a repair line corresponding to the dummy pixel from among the plurality of repair lines, a dummy circuit including a dummy driving transistor that is coupled between a driving voltage line to which a first driving voltage is applied and the output node, and a dummy initialization circuit including a dummy anode initialization transistor coupled between a dummy initialization voltage line to which a dummy initialization voltage is applied and the output node via a connectable structure. The connectable structure includes a first conductor and a second conductor that overlap, at least partially, with each other and are electrically insulated from each other.

20 Claims, 16 Drawing Sheets

(56) References Cited

U.S. PATENT DOCUMENTS

2013/0321292 A1 12/2013 Jeon
2015/0022513 A1* 1/2015 Kim ..... G09G 3/22 345/212
2015/0102312 A1* 4/2015 Lee ..... G09G 3/3233 257/40
2015/0138171 A1* 5/2015 Kim ..... H01L 27/3223 345/205
2015/0161931 A1* 6/2015 Lee ..... G09G 3/2007 345/77
2015/0170562 A1* 6/2015 In ..... G09G 3/3216 345/80
2015/0262526 A1* 9/2015 Park ..... G09G 3/3233 345/76

* cited by examiner

ORGANIC LIGHT-EMITTING DISPLAY

CROSS-REFERENCE TO RELATED APPLICATION

This application claims priority to and the benefit of Korean Patent Application No. 10-2014-0042535, filed on Apr. 9, 2014, in the Korean Intellectual Property Office, the disclosure of which is incorporated herein in its entirety by reference.

BACKGROUND

1. Field

One or more embodiments of the present invention relate to an organic light-emitting display apparatus, and more particularly, to an organic light-emitting display apparatus capable of repairing defective pixels by using dummy pixels and repair lines.

2. Description of the Related Art

During the manufacture of an organic light-emitting display apparatus, defective pixels may be generated. The defective pixels may be bright dots that always emit light or dark dots that do not emit light without regard to scan signals and data signals. Thus, a method of repairing such defective pixels and improving the yield of an organic light-emitting display apparatus is desirable. Also, there may be a problem that normally operating pixels that should display black gradation may display gray or that should display gray gradation may display black due to repaired pixels, while repairing the defective pixels into repaired pixels.

SUMMARY

One or more embodiments of the present invention include an organic light-emitting display apparatus capable of repairing defective pixels so that they emit light normally and at the same time, improve degradation in quality due to the repairing.

Additional aspects will be set forth in part in the description which follows and, in part, will be apparent from the description, or may be learned by practice of the presented embodiments.

According to one or more embodiments of the present invention, an organic light-emitting display apparatus includes: a plurality of pixels at active area; a plurality of dummy pixels at a dummy area; and a plurality of repair lines connected to the plurality of dummy pixels and connectable with the plurality of pixels, wherein each of the plurality of dummy pixels includes: an output node connected to a repair line corresponding to the dummy pixel from among the plurality of repair lines; a dummy circuit including a dummy driving transistor that is connected between a driving voltage line to which a first driving voltage is applied and the output node; and a dummy initialization circuit including a dummy anode initialization transistor connected between a dummy initialization voltage line to which a dummy initialization voltage is applied and the output node via a connectable structure, wherein the connectable structure may include a first conductor and a second conductor that overlap at least partially with each other and are electrically insulated from each other.

When a laser is irradiated to a portion where the first conductor and the second conductor of the connectable structure overlap with each other, the first conductor and the second conductor may be electrically connected to each other.

The plurality of pixels may include a first pixel including a pixel circuit and a light-emitting device that is electrically separated from the pixel circuit, the plurality of repair lines may include a first repair line that is electrically connected to the light-emitting device of the first pixel, the plurality of dummy pixels may include a first dummy pixel that is connected to the first repair line, a first conductor and a second conductor in a connectable structure of the first dummy pixel are electrically connected to each other, and when the dummy anode initialization transistor of the first dummy pixel is turned on, the dummy initialization voltage may be applied to the first repair line.

The first conductor may be electrically connected to the dummy anode initialization transistor, and the second conductor may be electrically connected to the output node or the dummy initialization voltage line.

The organic light-emitting display apparatus may further include: a plurality of data lines connected to the plurality of pixels; and at least one dummy data line connected to at least some of the plurality of dummy pixels and connectable with at least some of the plurality of data lines.

The active area may include a first sub-active area and a second sub-active area, the plurality of pixels comprise first pixels at the first sub-active area and second pixels at the second sub-active area, the plurality of dummy pixels may include first dummy pixels corresponding to the first pixels and second dummy pixels corresponding to the second pixels, the at least one dummy data line may include a first dummy data line connected to the first dummy pixels and a second dummy data line connected to the second dummy pixels, the first dummy data line is connectable with the data lines that are connected to the first pixels from among the plurality of data lines, and the second dummy data line may be connectable with the data lines that are connected to the second pixels from among the plurality of data lines.

The organic light-emitting display apparatus may further include a plurality of first control lines connected to the plurality of pixels and the plurality of dummy pixels, wherein each of the plurality of repair lines may be capacitively coupled to a corresponding one of the first control lines, which is located at the same row as a corresponding one of the repair lines.

Each of the plurality of pixels may include a pixel circuit and a light-emitting device including an anode electrode that is detachably connected to the pixel circuit, and each of the plurality of repair lines may be capacitively coupled to the anode electrodes of the pixels that are located at the same row as that of each of the repair lines.

Each of the plurality of pixels may include: a pixel circuit configured to receive a data signal and having an output node; an initialization circuit connected to the output node; and a light-emitting device that is detachably connected to the output node, wherein the pixel circuit may include a driving transistor for supplying a driving current corresponding to the data signal to the output node, and the initialization circuit may include an anode initialization transistor that is connected between an initialization voltage line, to which an initialization voltage is applied, and the output node.

The organic light-emitting display apparatus may further include a plurality of control lines that are connected to the plurality of pixels and the plurality of dummy pixels, wherein the plurality of control lines may include a plurality of scan lines for transmitting scan signals to the plurality of pixels and the plurality of dummy pixels, a plurality of emission control lines for transmitting emission control signals to the plurality of pixels and the plurality of dummy pixels, and a plurality of initialization control lines for transmitting initialization control signals to the plurality of pixels and the plurality of dummy pixels.

The dummy circuit may include: a dummy capacitor connected between the driving voltage line and a first node; a dummy switching transistor connected between the dummy data line for transmitting a data signal and a second node and controlled by the scan signal; a dummy compensating transistor connected between the first node and a third node and controlled by the scan signal; a dummy gate initialization transistor connected to an initialization voltage line to which an initialization voltage is applied or between the dummy initialization voltage line and the first node and controlled by the initialization control signal; a first dummy emission control transistor connected between the driving voltage line and the first node and controlled by the emission control signal; a second dummy emission control transistor connected between the third node and the output node and controlled by the emission control signal; and the dummy driving transistor connected between the second node and the third node and configured to output a driving current corresponding to a difference between a voltage at the first node and a voltage at the second node to the output node.

The initialization voltage line may be connected to the plurality of pixels, and a level of the initialization voltage may be higher than a level of the dummy initialization voltage.

The dummy anode initialization transistor may be controlled by the initialization control signal.

A frame period may include: a first section in which the dummy gate initialization transistor and the dummy anode initialization transistor are in turned on states by the initialization control signal; a second section in which the dummy switching transistor and the dummy compensating transistor are in turned on states by the scan signal; and a third section in which the first and second dummy emission control transistors are turned on by the emission control signal.

The plurality of control lines may further include a plurality of anode initialization control lines for transmitting anode initialization control signals to the plurality of pixels and the plurality of dummy pixels, and the dummy anode initialization transistor may be controlled by the anode initialization control signals.

Each of the plurality of dummy pixels may further include a coupling removal transistor that is connected to the dummy anode initialization transistor in parallel, and within one frame period, the coupling removal transistor may be turned on later than turning-off of the dummy anode initialization transistor.

The plurality of pixels may include first pixels located at the same row as a first dummy pixel including the coupling removal transistor, and within one frame period, the first pixels may emit light earlier than turning-off of the coupling removal transistor in the first dummy pixel.

Within one frame period, the first pixels may emit light later than turning-on of the coupling removal transistor in the first dummy pixel.

The plurality of pixels may include a second pixel that is connected to the first dummy pixel via the first repair line, and when the coupling removal transistor of the first dummy pixel is turned off, a light-emitting device of the second pixel may start to emit light.

The plurality of repair lines may include a first repair line, the plurality of dummy pixels comprise a first dummy pixel connected to the first repair line, and a first conductor and a second conductor in a connectable structure of the first dummy pixel may be electrically connected to each other, and when a dummy data line connected to a dummy circuit of the first dummy pixel floats, the dummy circuit of the first dummy pixel may be configured so that an electric potential of the first repair line swings between a level of the first driving voltage and a level of the dummy initialization voltage with one frame period.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
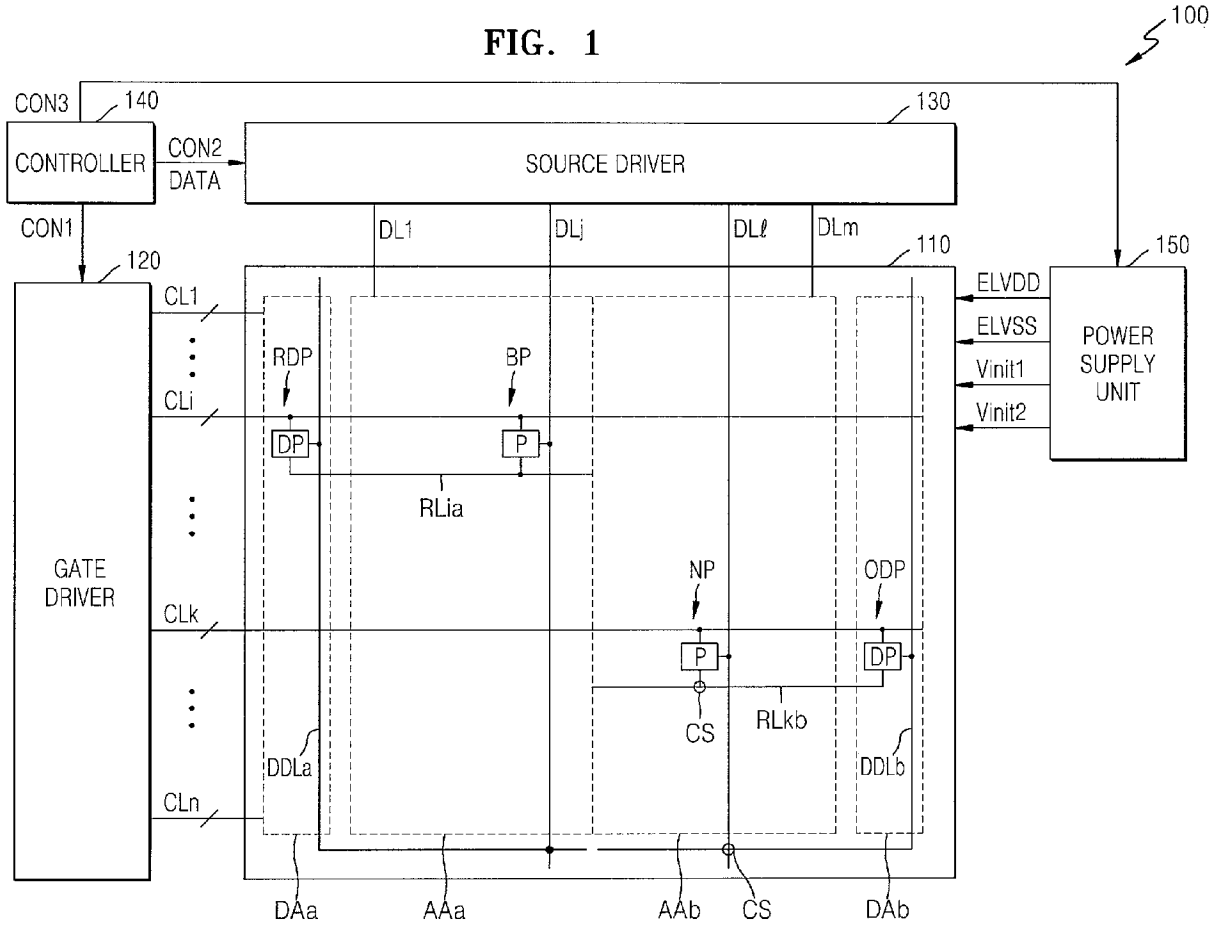
FIG. 1 is a schematic block diagram of an organic light-emitting display apparatus, according to an embodiment of the present invention.

Reference will now be made in detail to embodiments, examples of which are illustrated in the accompanying drawings. In this regard, the present embodiments may have different forms and should not be construed as being limited to the descriptions set forth herein. Accordingly, the embodiments are merely described below, by referring to the figures, to explain aspects of the present description.

In the accompanying drawings, those components that are the same or are in correspondence are rendered the same reference numeral regardless of the figure number, and redundant explanations may not be provided.

Throughout the specification, while terms "first" and "second" are used to describe various components, it is obvious that the components are not limited to the terms "first" and "second". The terms "first" and "second" are used to distinguish between each component. Throughout the specification, a singular form may include plural forms, unless there is a particular description contrary thereto. Also, terms such as "comprise", "comprising", "include" and "including" are used to specify existence of a recited form, and/or a component, not excluding the existence of one or more other recited forms, and/or one or more other components. As used herein, the term "and/or" includes any and all combinations of one or more of the associated listed items. Further, when a first element is described as "coupled" or "connected" to a second element, the first element may be directly coupled or directly connected to the second element, or may be indirectly coupled or indirectly connected to the second element via one or more intervening elements. Expressions such as "at least one of," when preceding a list of elements, modify the entire list of elements and do not modify the individual elements of the list.

FIG. 1 is a block diagram of an organic light-emitting display apparatus 100, according to an embodiment of the present invention.

Referring to FIG. 1, the organic light-emitting display apparatus 100 includes a display panel 110, a gate driver 120, a source driver 130, a controller 140, and a power supply unit 150. The gate driver 120, the source driver 130, and the controller 140 may be formed in respectively separate semiconductor chips, or may be integrated in one semiconductor chip. The organic light-emitting display apparatus 100 may include, for example, an electronic device capable of displaying images such as a smartphone, a tablet PC, a laptop computer, a monitor, or a TV, and a component for displaying images in such an electronic device.

The display panel 110 may include an active area including a first sub-active area AAa and a second sub-active area AAb, and a dummy area including a first sub-dummy area DAa and a second sub-dummy area DAb. Hereinafter, the entire active area will be referred to as an active area AA, and the entire dummy area will be referred to as a dummy area DA. The active area AA is an area in which images are displayed due to light emission of pixels P, and thus, may be referred to as a display area. The dummy area DA may be located at a non-active area that is adjacent to the active area AA. The dummy area DA may be located at least one selected from the group consisting of left, right, upper, and lower sides of the active area AA. As shown in FIG. 1, the dummy area DA may be located at left and right sides of the active area AA.

In FIG. 1, the active area AA is divided into two sub-active areas, namely, the first and second sub-active areas AAa and AAb, and the dummy area DA is also divided into two sub-dummy areas, namely, the first and second sub-dummy areas DAa and DAb. However, the one or more embodiments of the present invention are not limited thereto, and the active area AA may be divided into three or more sub-active areas, and accordingly, the dummy area DA may be divided into three or more sub-dummy areas. Although it will be described in detail below, one pixel of each sub-active area may be repaired by using dummy pixels arranged in sub-dummy areas corresponding to the above sub-active areas of the pixels. That is, in a case where the active area AA is divided into four sub-active areas, if four defective pixels are respectively included in the four sub-active areas, all the four defective pixels may be repaired.

A plurality of pixels P that are connected (or coupled) to a plurality of control lines CL1 through CLn extending in a row direction (e.g., a transverse direction in FIG. 1) and a plurality of data lines DL1 through DLm extending in a column direction (e.g., a longitudinal direction in FIG. 1) may be arranged in the active area AA. For convenience of description, only two pixels P are shown in FIG. 1.

A plurality of dummy pixels DP that are connected to first and second dummy data lines DDLa and DDLb and the plurality of control lines CL1 through CLn are arranged in the dummy area DA. The first dummy data line DDLa and the plurality of dummy pixels DP connected to the first dummy data line DDLa are arranged in a column direction in the first sub-dummy area DAa, and the second dummy data line DDLb and the plurality of dummy pixels DP connected to the second dummy data line DDLb are arranged in the column direction in the second sub-dummy area DAb. For convenience of description, two dummy pixels DP are shown in FIG. 1.

The first dummy data line DDLa may include a first portion connected to the dummy pixels DP in the first sub-dummy area DAa, and a second portion that is connectable to the data lines (e.g., DL1 and DLj) that are connected to the pixels P in the first sub-active area AAa corresponding to the first sub-dummy area DAa. The second dummy data line DDLb may include a first portion connected to the dummy pixels DP in the second sub-dummy area DAb, and a second portion that is connectable to the data lines (e.g., DLl and DLm) that are connected to the pixels P in the second sub-active area AAb. The first portions of the first and second dummy data lines DDLa and DDLb may be located at the first and second sub-dummy areas DAa and Dab, respectively. The second portions of the first and second dummy data lines DDLa and DDLb may be located at a dead space outside the active area AA and the dummy area DA. The dead space is a space in which the pixels P and the dummy pixels DP are not arranged in the display panel 110. Because the second portions of the first and second dummy data lines DDLa and DDLb are located at the dead space, the second portions of the first and second dummy data lines DDLa and DDLb may be formed with a large design margin and may have greater widths or thickness in order to have low line resistances.

The number of dummy data lines DDLa and DDLb may be equal to the number of sub-dummy areas of the dummy area DA and the number of sub-active areas of the active area AA. For example, if the first and second sub-active areas AAa and AAb and the first and second sub-dummy areas DAa and DAb are divided in an up-and-down (e.g., vertical) direction so that the dummy area DA and the active area AA may be divided respectively into four sub-dummy areas (e.g., first to fourth sub-dummy areas DAa through DAd) and four sub-active areas (e.g., first to fourth sub-active areas AAa through AAd), four dummy data lines (e.g., first to fourth data lines DDLa through DDLd) may be formed. In this case, the fourth dummy data line DDLd is connected to dummy pixels DP in the fourth sub-dummy area DAd and may be connected to data lines that are connected to the pixels P in the fourth sub-active area AAd. Hereinafter, an example in which the active area AA and the dummy area DA are respectively divided into two sub-active areas AAa and AAb and two sub-dummy areas DAa and Dab will be described. However, one of ordinary skill in the art will understand that the one or more embodiments of the present invention may be applied to a case where the active area AA and the dummy area DA are divided respectively into three or more sub-active areas and sub-dummy areas.

In FIG. 1, each of the control lines CL1 through CLn is represented as a single signal line; however, each of the control lines CL1 through CLn may include a plurality of signal lines. According to an embodiment, the first control line CL1 may include three signal lines for transmitting a scan signal GW, an initialization control signal GI, and an emission control signal EM. According to another embodiment, the first control line CL1 may further include a signal line for transmitting an anode initialization control signal GA.

The display panel 110 may include a plurality of first and second repair lines RL1*a* through RLna and RL1*b* through RLnb that extend in parallel with the plurality of control lines CL1 through CLn. The first repair lines RL1*a* through RLna are connected to the dummy pixels DP arranged in the first sub-dummy area DAa and connectable to the pixels P that are arranged in the first sub-active area AAa. The second repair lines RL1*b* through RLnb may be connected to the dummy pixels DP arranged in the second sub-dummy area DAb and connectable to the pixels P arranged in the second sub-active area AAb.

A unit pixel may include a plurality of sub-pixels for emitting various light colors in order to display the various colors. In the present specification, the pixel P may denote a sub-pixel. However, the one or more embodiments of the present invention are not limited thereto, and the pixel P may denote a unit pixel including the plurality of sub-pixels. That is, a pixel P in the present specification may be interpreted as that one sub-pixel is arranged or that a plurality of sub-pixels forming one unit pixel are arranged. This may also be applied to the dummy pixels DP. For example, that one dummy pixel is arranged may be interpreted as that one dummy pixel is arranged or dummy sub-pixels, the number of which corresponds to that of the sub-pixels forming one unit pixel, are arranged. If one dummy pixel is interpreted as dummy sub-pixels, a dummy data line connected to the dummy pixel may be interpreted as including a plurality of dummy data lines respectively connected to the dummy sub-pixels.

Throughout the specification, the term "connectable" or "connectably" means that two elements may be connected to each other by using a laser or the like in a repair process. For example, the description that a first conductor and a second conductor are connectably disposed or arranged may mean that the first conductor and the second conductor are actually insulated from each other electrically but they may be connected to each other in a subsequent repair process. Structurally, the first conductor and the second conductor that are "connectable" with each other may be arranged so as to overlap with each other at least partially by having an insulating layer disposed therebetween in an overlapping area. In the repair process, when a laser is irradiated to the overlapping area, the insulating layer in the overlapping area is removed so that the first conductor and the second conductor are electrically connected (or electrically coupled) to each other.

In the drawings attached to the specification, a crossing point between the first conductor and the second conductor is represented by a white circle and denoted by connectable structure (CS), so that the first conductor and the second conductor that are "connectable" with each other may be distinguished easily. As shown in FIG. 1, the pixel P connected to the control line CLk and the data line DLl is connected to the repair line RLkb via the connectable structure CS. Also, the data line DLl and the second dummy data line DDLb that are connectable with each other may be connected to each other via a connectable structure CS. That is, the data line DLl and the second dummy data line DDLb are actually insulated from each other; however, if laser is irradiated to the connectable structure CS in the repair process, the data line DLl and the second dummy data line DDLb may be electrically connected to each other.

Also, in the present specification, the term "detachable" or "detachably" means that two elements may be detached by using a laser or the like in the repair process. For example, the description that a first member and a second member are detachably connected to each other denotes that the first member and the second member are actually connected to each other electrically, but may be later detached and electrically insulated from each other in the repair process. Structurally, the first member and the second member that are detachably connected may be connected to each other by using a conductive connection member (e.g., a conductive wiring). In the repair process, when a laser is irradiated to the conductive connection member, a part of the conductive connection member, which is laser-irradiated, is melted and then is cut off, so that the first member and the second member are electrically separated and insulated. In the present embodiment, the conductive connection member may include a silicon layer that is melted by a laser. In another embodiment, the conductive connection member may be melted by joule heat due to a current and then may be cut.

The gate driver 120 provides the pixels P and the dummy pixels DP with control signals via the control lines CL1 through CLn, and the source driver 130 may provide the pixels P with data signals via the data lines DL1 through DLm. As shown in FIG. 1, the source driver 130 may not be directly connected to the first and second dummy data lines DDLa and DDLb. According to another embodiment, the source driver 130 may be directly connected to the first and second dummy data lines DDLa and DDLb so as to directly provide the dummy pixels DP with dummy data signals.

The controller 140 may control the gate driver 120, the source driver 130, and the power supply unit 150. The controller 140 may generate first through third control signals CON1, CON2, and CON3 and digital image data DATA based on a horizontal synchronization signal and a vertical synchronization signal. The controller 140 may provide the gate driver 120 with the first control signal CON1, the source driver 130 with the second control signal CON2 and digital image data DATA, and the power supply unit 150 with the third control signal CON3. The power supply unit 150 may apply a first driving voltage ELVDD, a second driving voltage ELVSS, and first and second initialization voltages Vinit1 and Vinit2 to the pixels P and/or the dummy pixels DP. The first initialization voltage Vinit1 may be referred to as an initialization voltage, and the second initialization voltage Vinit2 may be referred to as a dummy initialization voltage in that the second initialization voltage Vinit2 is applied to the dummy pixels DP.

It is assumed that the pixel P in the second sub-active area AAb is a normal pixel NP that normally operates (e.g., functions/operates as designed or expected). The normal pixel NP shown in FIG. 1 may be connectable with the second repair line RLkb via the connectable structure CS, and the data line DLl connected to the normal pixel NP may be connectable with the second dummy data line DDLb via the connectable structure CS. As described above, the normal pixel NP and the second repair line RLkb are electrically insulated from each other, and the data line DLl and the second dummy data line DDLb are electrically insulated from each other.

In the described embodiment, if the pixels P on the second sub-active area AAb are all normal, the second dummy data line DDLb is not electrically connected to any of the data lines, but floats. The dummy pixels DP arranged in the second sub-dummy area DAb may be referred to as open dummy pixels ODP because they do not need to perform repair operations and are not electrically connected to other pixels P.

It is assumed that the pixel P on the first sub-active area AAa of FIG. 1 is a bad pixel (i.e., a pixel that does not function as designed or expected) BP. The bad pixel BP is electrically connected to the first repair line RLia from among the first repair lines. Also, the data line DLj connected to the bad pixel BP is electrically connected to the first dummy data line DDLa. The electric connection between the bad pixel BP and the first repair line RLia and the electric connection between the data line DLj and the first dummy data line DDLa may be achieved by irradiating laser to the connectable structures CS during the repair process.

The bad pixel BP is electrically connected to a dummy pixel DP corresponding to the bad pixel BP via the first repair line RLia, from among the dummy pixels DP arranged in the first sub-dummy area DAa. A data signal provided to the bad pixel BP is applied to the dummy pixel DP corresponding to the bad pixel BP via the first dummy data line DDLa that is connected to the data line DLj. The dummy pixel DP corresponding to the bad pixel BP generates a driving current corresponding to the data signal and provides the bad pixel BP with the driving current via the first repair line RLia. The bad pixel BP includes a light-emitting device that is electrically isolated from a pixel circuit, and the driving current supplied from the dummy pixel DP corresponding to the bad pixel BP is provided to the light-emitting device so that the light-emitting device emits light at a luminance corresponding to the data signal. Because the bad pixel BP normally operates through the repair process, the bad pixel BP may be referred to as a repaired pixel. Also, the dummy pixel DP corresponding to the bad pixel BP may be referred to as a repair dummy pixel RDP because the dummy pixel DP corresponding to the bad pixel BP is used in the repair process of the bad pixel BP.

Throughout the specification, the term "correspond" or "corresponding" may be used to specify an element, from among a plurality of elements, which is located or arranged at the same column or row as another element. For example, the description that a first member is connected to a second member "corresponding" to the first member from among a plurality of second members may mean that the first member is connected to the second member that is located or arranged at the same column or row as the first member.

Figure 2:
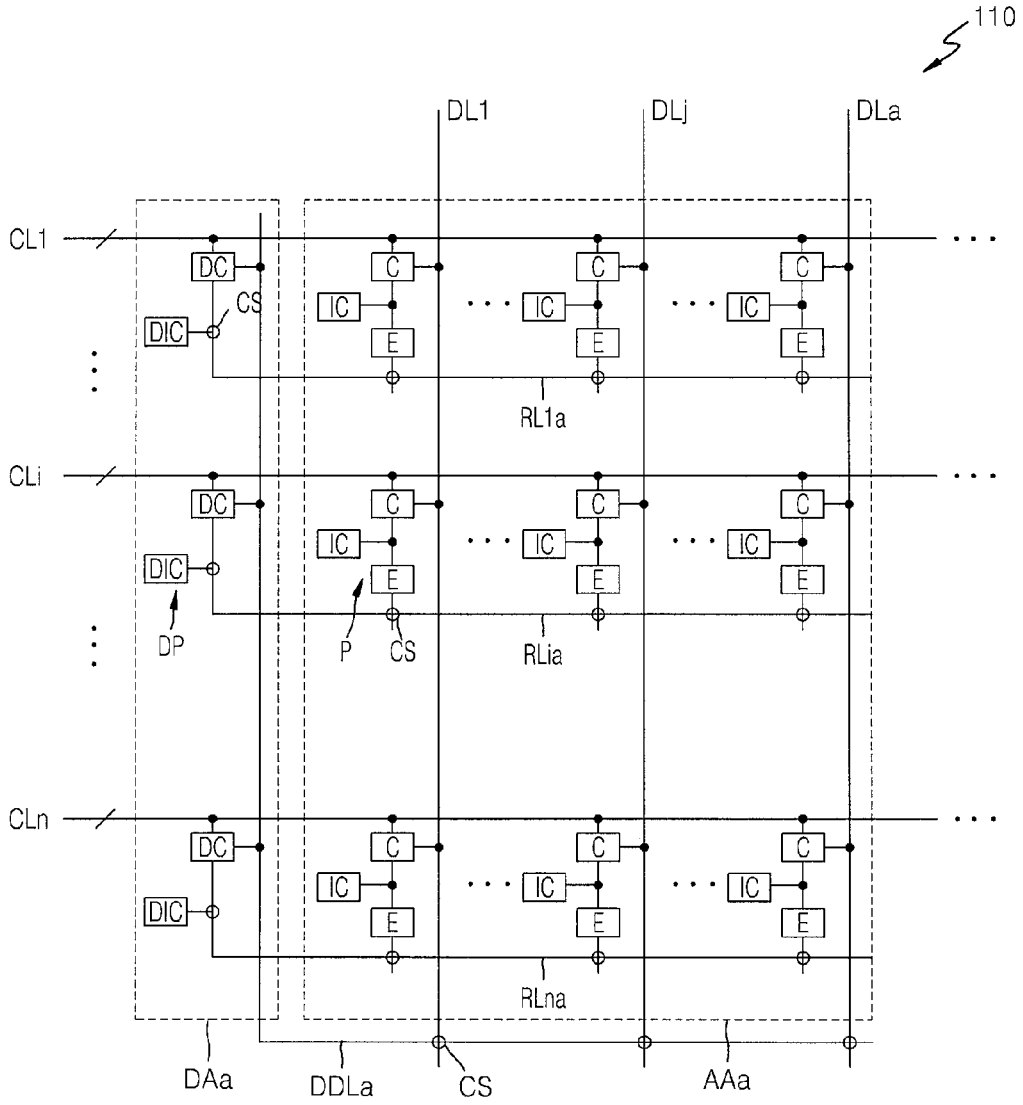
FIG. 2 is a schematic diagram of a display panel of FIG. 1, according to an embodiment of the present invention.

FIG. 2 is a schematic diagram of the display panel 110 of FIG. 1, according to an embodiment of the present invention.

FIG. 2 shows a part of the display panel 110, that is, the first sub-active area AAa and the first sub-dummy area DAa.

Each of the pixels P arranged in the first sub-active area AAa includes a pixel circuit C, a light-emitting device E for emitting light by receiving a driving current from the pixel circuit C, and an initialization circuit IC for initializing the light-emitting device E. The pixel circuit C and the initialization circuit IC are connected to each other, and the light-emitting device E may be detachably connected to the pixel circuit C and the initialization circuit IC. The pixel circuit C may include one or more thin film transistors (TFTs) and capacitors. The initialization circuit IC may include one or more TFTs. The pixel P may emit light of, for example, one of red, green, blue, and white colors. However, one or more embodiments of the present invention are not limited thereto, the pixel P may emit light of other colors than the red, green, blue, and white colors.

The light-emitting devices E in the pixels P may be connectable with the repair lines corresponding to the light-emitting devices E, that is, the repair lines in the same rows, via the connectable structure CS. That is, the light-emitting device E is electrically insulated from the repair line corresponding to the light-emitting device E and may be electrically connected to the repair line corresponding to the light-emitting device E in the repair process.

The dummy pixels DP are arranged in the first sub-dummy area DAa along the column direction. Each of the dummy pixels DP includes a dummy circuit DC and a dummy initialization circuit DIC but does not include a light-emitting device. The dummy circuit DC may be the same as the pixel circuit C. According to another embodiment, the dummy circuit DC may be different from the pixel circuit C. For example, the dummy circuit DC may correspond to the pixel circuit C, in which some transistors and/or capacitors may be omitted or some transistors and/or capacitors may be added. Sizes and characteristics of the transistors and/or capacitors in the dummy circuit C may be different from those of the transistors and/or the capacitors in the pixel circuit C. The dummy circuit DC is connected to the repair line corresponding to the dummy circuit DC.

The dummy initialization circuit DIC is connectable with the dummy circuit DC via the connectable structure CS. That is, the dummy initialization circuit DIC is electrically insulated from the dummy circuit DC and the repair line corresponding to the dummy circuit DC and may be electrically connected to the dummy circuit DC and the repair line corresponding to the dummy circuit DC in the repair process. The dummy initialization circuit DIC may be different from the initialization circuit IC. For example, a level of the dummy initialization voltage applied to the dummy initialization circuit DIC may be different from that of the initialization voltage applied to the initialization circuit IC. According to another embodiment, the dummy initialization circuit DIC may further include a transistor, compared to the initialization circuit IC. According to another embodiment, the dummy initialization circuit DIC may be the same as the initialization circuit IC, except that the dummy initialization circuit DIC is connectable with the dummy circuit DC via the connectable structure CS.

The dummy pixels DP on the first sub-dummy area DAa are connected to the first dummy data line DDLa, and the first dummy data line DDLa is disposed connectably with the data lines DL1 to DLa via the connectable structures CSs. That is, the first dummy data line DDLa is electrically insulated from the data lines DL1 to DLa and then may be electrically connected to one of the data lines DL1 to DLa in the repair process.

Figure 3:
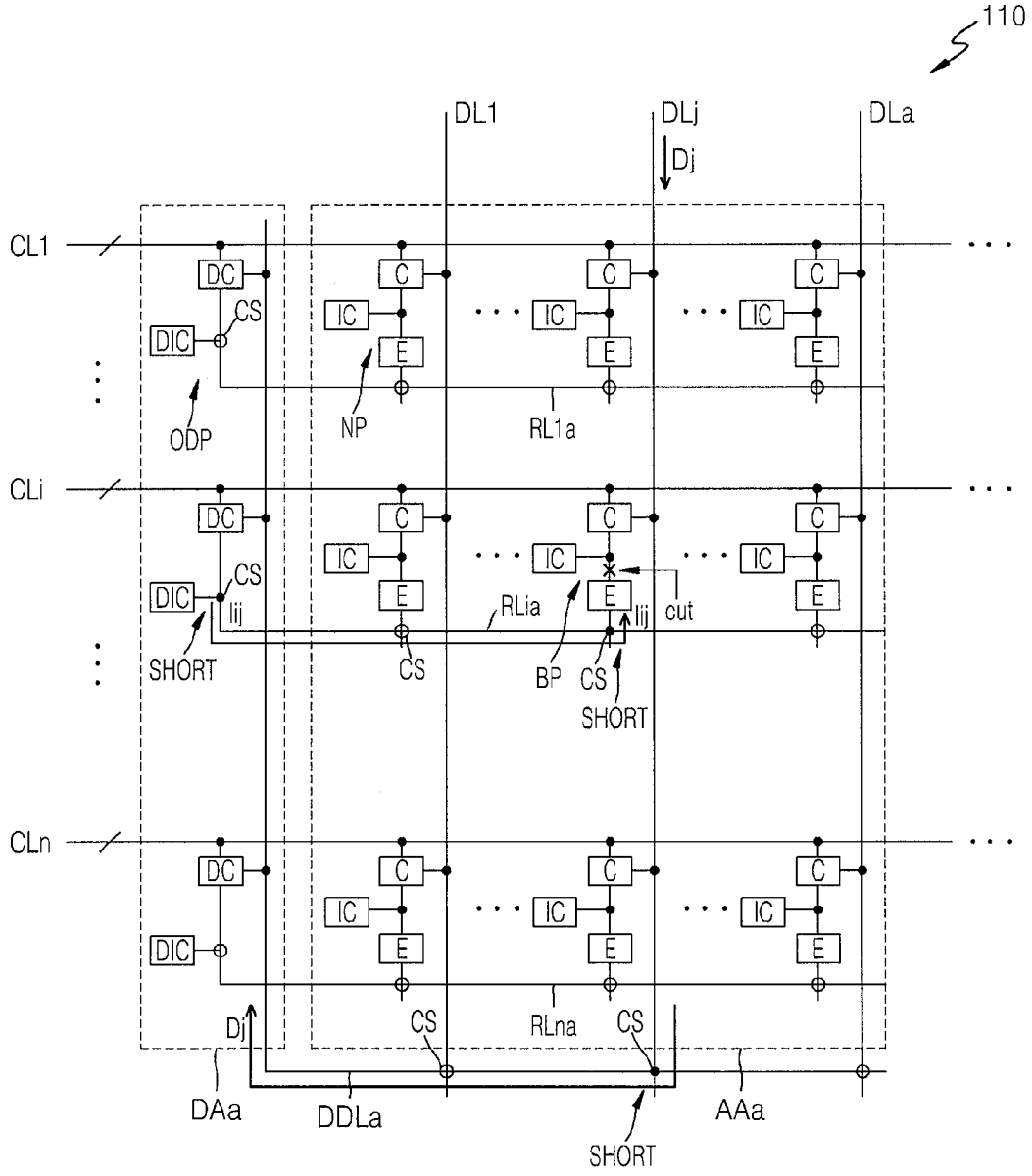
FIG. 3 is a schematic diagram illustrating a method of repairing a defective pixel by using a repair line in the display panel of FIG. 2, according to an embodiment of the present invention.

FIG. 3 is a diagram illustrating a method of repairing a bad pixel by using a repair line in the display panel 110 of FIG. 2, according to an embodiment of the present invention.

Hereinafter, a case where the pixel circuit C of the pixel P that is connected to an i-th control line CLi and a j-th data line DLj from among the pixels P formed on the first sub-active area AAa is defective will be described as an example and referred to as a bad pixel BP.

Referring to FIG. 3, the light-emitting device E of the bad pixel BP is isolated from the pixel circuit C and the initialization circuit IC. For example, a laser is irradiated to a connection line extending from a connection node of the pixel circuit C and the initialization circuit IC to the light-emitting device E to cut the connection line, and thus, the light-emitting device E of the bad pixel BP may be electrically insulated from the pixel circuit C and the initialization circuit IC.

The light-emitting device E of the bad pixel BP and the dummy circuit DC of a dummy pixel DPi are electrically connected to each other. The light-emitting device E of the bad pixel BP is connected to a repair line RLia in the same row. For example, a laser is irradiated to the connectable structure CS between the light-emitting device E of the bad pixel BP and the repair line RLia so as to break the insulating layer between first and second conductors of the connectable structure CS, and accordingly, the first and second conductors may be electrically connected to each other. As a result, the light-emitting device E of the bad pixel BP is electrically connected to the repair line RLia. Because the repair line RLia is connected to the dummy circuit DC, the light-emitting device E of the bad pixel BP is connected to the dummy circuit DC of the dummy pixel DPi. In FIG. 3, in a case where the first and second conductors of the connectable structure CS are electrically insulated from each other, the connectable structure CS is denoted by a white circle, and in a case where the first and second conductors of the connectable structure CS are electrically connected to each other, the connectable structure CS is denoted by a black circle.

The dummy initialization circuit DIC of the dummy pixel DPi is electrically connected to the dummy circuit DC of the dummy pixel DPi. For example, a laser is irradiated to the connectable structure CS between the dummy circuit DC and the dummy initialization circuit DIC of the dummy pixel DPi, and then, the dummy initialization circuit DIC is electrically connected to the dummy circuit DC and the repair line RLia.

The data line DLj and the first dummy data line DDLa that are connected to the bad pixel BP are electrically connected to each other. For example, the laser is irradiated to the connectable structure CS between the data line DLj and the first dummy data line DDLa so that the data line DLj and the first dummy data line DDLa may be electrically connected to each other.

The pixel circuit C of the bad pixel BP and the dummy circuit DC of the dummy pixel DPi concurrently (e.g., simultaneously) respond to a scan signal applied via the same scan line from among the control lines CLi. The data line DLj connected to the pixel circuit C of the bad pixel BP is connected to the first dummy data line DDLa, and thus, a data signal Dj applied to the pixel circuit C of the bad pixel BP is also applied to the dummy circuit DC of the dummy pixel DPi. The dummy circuit DC generates a driving current Iij corresponding to the data signal Dj and supplies the driving current Iij to the light-emitting device E of the bad pixel BP via the repair line RLia. The light-emitting device E of the bad pixel BP emits light at a luminance corresponding to the data signal Dj by using the driving current Iij. Therefore, the bad pixel BP may be repaired to functions as a normal pixel.

In the present example, because the first dummy data line DDLa is connected to the data line DLj, there is no need to additionally drive a dummy data line DDL. Therefore, an additional timing after the repair process or modification of the source driver 130 to drive the dummy data line DDL is not necessary.

Figure 4A:
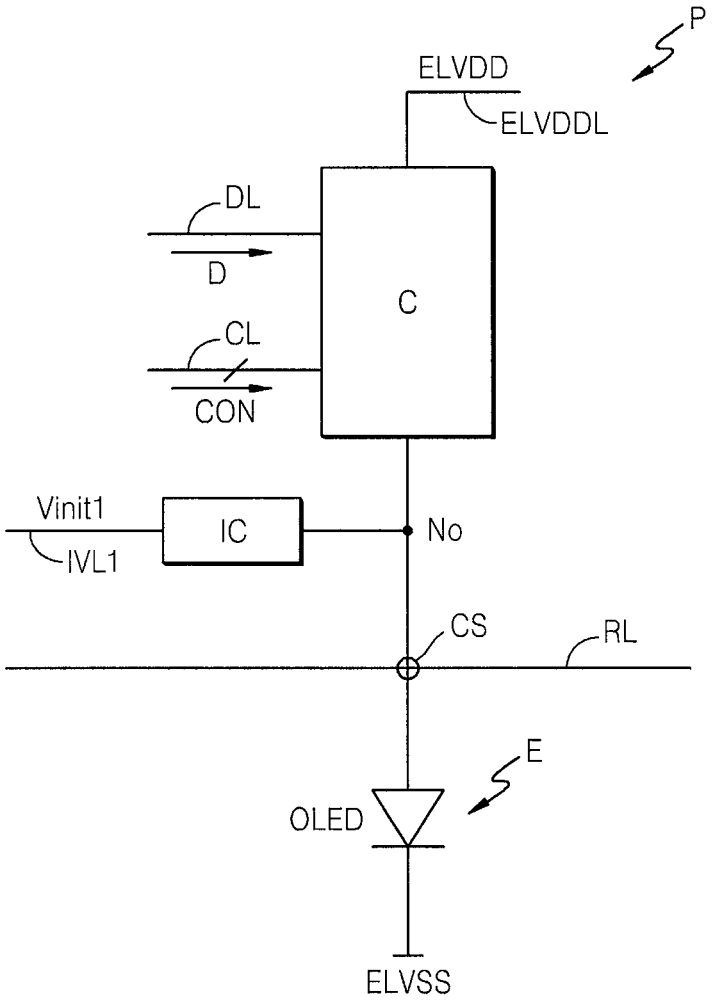
FIG. 4A is a schematic diagram of a pixel in an organic light-emitting display apparatus, according to an embodiment of the present invention.

FIG. 4A is a schematic diagram of the pixel P in an organic light-emitting display apparatus, according to an embodiment of the present invention.

Referring to FIG. 4A, the pixel P includes the pixel circuit C, the initialization circuit IC, and the light-emitting device E. The pixel P has an output node No at which the pixel circuit C, the initialization circuit IC, and the light-emitting device E are connected to each other.

The pixel circuit C is connected to a driving voltage line ELVDDL, a data line DL arranged in the same column as that of the pixel P, and the control lines CL arranged in the same row as that of the pixel P. The pixel circuit C receives the first driving voltage ELVDD via the driving voltage line ELVDDL, receives the data signal D via the data line DL, and receives a control signal CON via the control lines CL. The pixel circuit C includes a driving transistor supplying the driving current corresponding to the data signal D to the output node No.

The initialization circuit IC includes an anode initialization transistor connected between a first initialization voltage line IVL1 to which a first initialization voltage Vinit1 is applied and the output node No. When the anode initialization transistor is turned on, the first initialization voltage Vinit1 is applied to the output node No. The anode initialization transistor is turned on during a non-emission period in which the light-emitting device E does not emit light. The anode initialization transistor that is turned on lowers an electric potential of an anode terminal of the light-emitting device E to an initialization level that is lower than a threshold voltage of the light-emitting device E and may prevent the light-emitting device E from emitting light slightly due to a leakage current of the driving transistor when the data signal D corresponding to black level is applied to the pixel circuit C.

The light-emitting device E includes an organic light-emitting diode (OLED) including an anode electrode (or anode terminal) connected to the output node No and a cathode electrode (or cathode terminal) to which the second driving voltage ELVSS is applied. A wiring between the light-emitting device E and the output node No may be arranged connectably with a repair line RL that is arranged in the same column as that of the pixel P via the connectable structure CS.

If the pixel circuit C or the initialization circuit IC is defective, laser is irradiated to the connectable structure CS so that the anode terminal of the light-emitting device E may be connected to the repair line RL. When the laser is irradiated to a wiring between the connectable structure CS and the output node No to cut the wiring, the light-emitting device E is electrically insulated from the output node No.

Figure 4B:
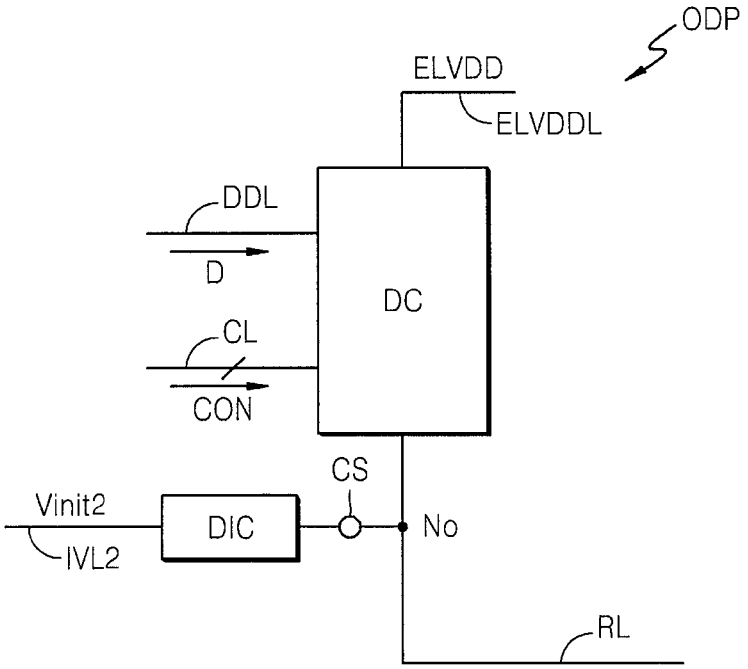
FIG. 4B is a schematic diagram of an open dummy pixel in an organic light-emitting display apparatus, according to an embodiment of the present invention.

FIG. 4B is a schematic diagram of an open dummy pixel ODP in the organic light-emitting display apparatus, according to an embodiment of the present invention.

Referring to FIG. 4B, the open dummy pixel ODP is a dummy pixel DP that is not used to repair the bad pixel BP and is not connected to the light-emitting device E of the pixel P. The open dummy pixel ODP includes a dummy circuit DC and a dummy initialization circuit DIC. The open dummy pixel ODP has an output node No at which the dummy circuit DC and the repair line RL are connected to each other.

The dummy circuit DC is connected to the driving voltage line ELVDDL, the dummy data line DL, and the control lines CL that are arranged in the same row as that of the open dummy pixel ODP. The dummy circuit DC receives the first driving voltage ELVDD via the driving voltage line ELVDDL and receives control signals CON via the control lines CL. If the dummy data line DDL is electrically connected to another data line DL, the dummy circuit DC may receive a data signal D via the dummy data line DDL. However, if the dummy data line DDL is not connected to any of data lines DL, the dummy data line DDL floats and the dummy circuit DC may not receive the data signal D. The dummy circuit DC includes a dummy driving transistor connected between the driving voltage line ELVDDL and the output node No.

The dummy initialization circuit DIC includes a dummy anode initialization transistor connected between a second initialization voltage line IVL2, to which the second initialization voltage Vinit2 is applied, and the output node No via the connectable structure CS. In FIG. 4B, the connectable structure CS is located between the dummy initialization circuit DIC and the output node No; however, the connectable structure CS may be located between the dummy initialization circuit DIC and the second initialization voltage line IVL2. Even when the dummy anode initialization transistor is turned on, a second initialization voltage Vinit2 is not applied to the output node No due to the connectable structure CS. A level of the second initialization voltage Vinit2 may be equal to or lower than that of the first initialization voltage Vinit1.

Because the open dummy pixel ODP is not used in the repair process, a closed circuit is not configured via the repair line RL. The repair line RL has a parasitic capacitance with respect to other conductors around the repair line RL (e.g., other control lines, an anode electrode of the pixel P, a substrate, etc.). When the dummy circuit DC receives the data signal D, the dummy driving transistor outputs a driving current corresponding to the data signal D to the output node No, and a parasitic capacitor of the repair line RL is charged so that an electric potential of the repair line RL increases. However, because the second initialization voltage Vinit2 is not applied to the output node No, the electric potential of the repair line RL does not decrease to the level of the second initialization voltage Vinit2. Therefore, although the electric potential of the repair line RL varies depending on the data signal D, the electric potential of the repair line RL does not swing largely between the first driving voltage ELVDD level and the second initialization voltage Vinit2 level.

If the dummy data line DDL connected to the dummy circuit DC floats, the dummy circuit DC may not receive the data signal D. Even when the dummy driving transistor is completely turned on due to the floating dummy data line DDL and the electric potential of the repair line RL rises to the level of the first driving voltage ELVDD, the electric potential of the repair line RL does not decrease to the level of the second initialization voltage Vinit2 because the second initialization voltage Vinit2 is not applied to the output node No. Therefore, the electric potential does not swing largely between the first driving voltage ELVDD level and the second initialization voltage Vinit2 level.

Figure 4C:
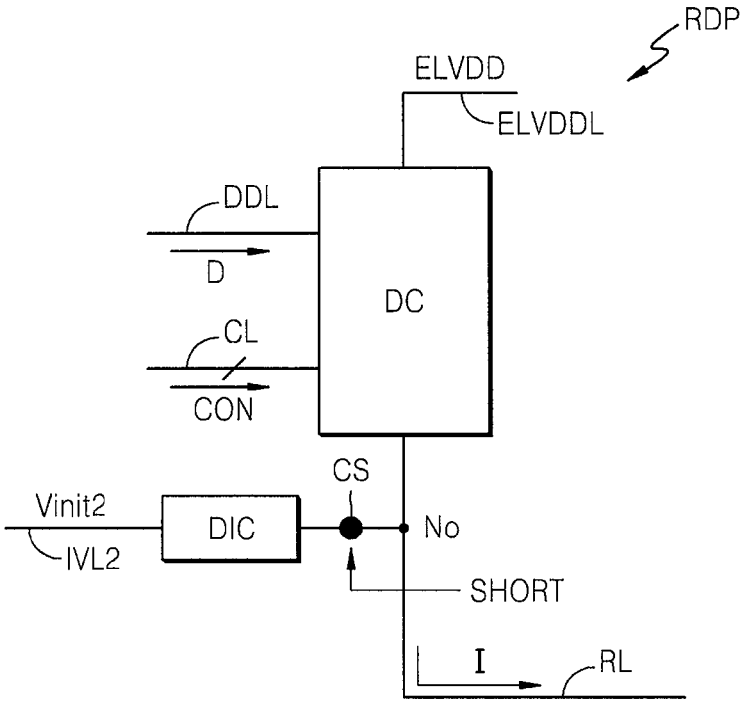
FIG. 4C is a schematic diagram of a repair dummy pixel in an organic light-emitting display apparatus, according to an embodiment of the present invention.

FIG. 4C is a schematic diagram of a repair dummy pixel RDP in the organic light-emitting display apparatus, according to an embodiment of the present invention.

Referring to FIG. 4C, the repair dummy pixel RDP is a dummy pixel DP that is used to repair the bad pixel BP and is connected to the light-emitting device E of the bad pixel BP via the repair line RL. The repair dummy pixel RDP includes the dummy circuit DC and the dummy initialization circuit DIC, like the open dummy pixel ODP. Repeated descriptions about common components of the repair dummy pixel RDP and the open dummy pixel ODP are not provided.

Because the dummy data line DDL is electrically connected to the data line DL that is connected to the bad pixel BP, the dummy circuit DC receives the data signal D applied to the bad pixel BP via the dummy data line DDL. The dummy circuit DC includes a dummy driving transistor that is connected between the driving voltage line ELVDDL and the output node No and outputs the driving current corresponding to the data signal D to the output node No.

Because first and second conductors in the connectable structure CS of the repair dummy pixel RDP are electrically connected to each other in the repair process, the connectable structure CS is equal to a conductor functioning as a connection node. As shown in FIG. 4C, the connectable structure CS functioning as a connection node is denoted by a black circle.

The dummy initialization circuit DIC includes a dummy anode initialization transistor that is connected between the second initialization voltage line IVL2, to which the second initialization voltage Vinit2 is applied, and the output node No via the connectable structure CS that functions as the connection node. Therefore, when the dummy anode initialization transistor is turned on, the second initialization voltage Vinit2 is applied to the output node No like in the anode initialization transistor of the pixel P.

The dummy anode initialization transistor is turned on within a non-emission period, in which the light-emitting device E of the bad pixel BP does not emit light, like the anode initialization transistor of the initialization circuit IC. The dummy anode initialization transistor that is turned on decreases the potential of the anode terminal of the light-emitting device E of the bad pixel BP to an initialization level that is lower than the threshold voltage of the light-emitting device E, whereby preventing the light-emitting device E of the bad pixel BP from emitting light slightly due to the leakage current of the driving transistor when the data signal D corresponding to black is applied to the dummy circuit DC.

The level of the second initialization voltage Vinit2 may be lower than that of the first initialization voltage Vinit1. The dummy initialization circuit DIC of the repair dummy pixel RDP is connected to the repair line RL, and the repair line RL is affected by (e.g., largely affected by) potential variation of peripheral conductors (e.g., other control lines, anode electrodes in the pixels P of the same columns) due to its long length. If the potential of the repair line RL is boosted due to a capacitive coupling with other conductors in the repair line RL, the light-emitting device E of the bad pixel BP may emit light even when the data signal corresponding to black is input thereto. To address the above problem, the level of the second initialization voltage Vinit2 is set to be lower than that of the first initialization voltage Vinit1 so as to ensure a margin covering the potential variation due to the capacitive coupling with other conductors in the repair line RL.

Figure 5A:
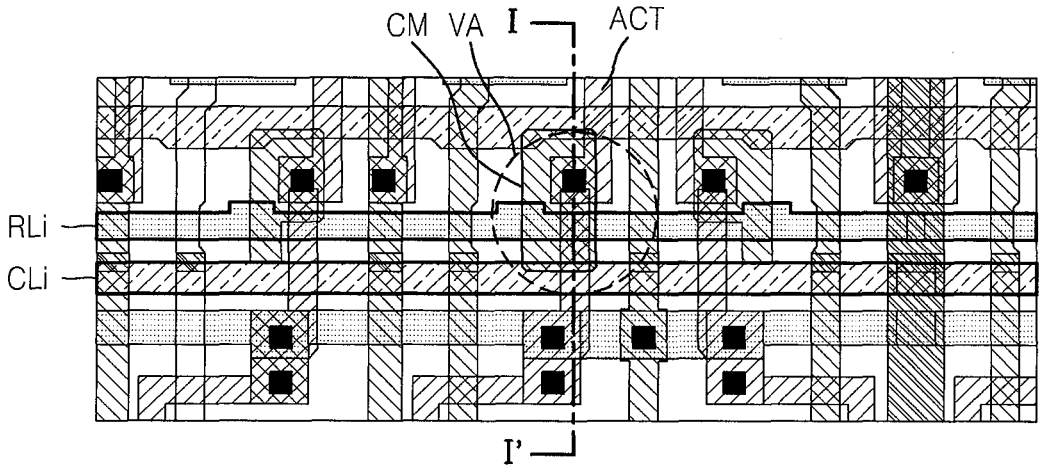
FIG. 5A is a schematic plan view of a part of a display panel according to an embodiment of the present invention.
Figure 5B:
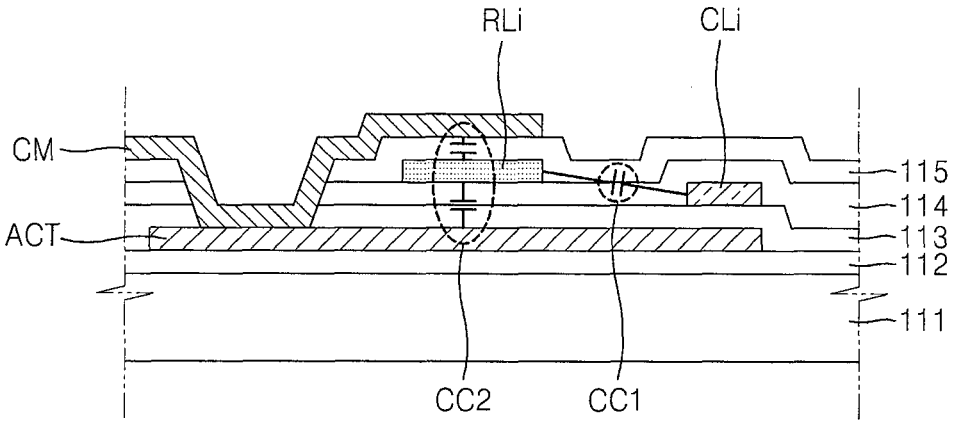
FIG. 5B is a schematic cross-sectional view of a via hole area, which is taken along the line I-I' of FIG. 5A, according to an embodiment of the present invention.

FIG. 5A is a schematic plan view of a part of a display panel, according to an embodiment of the present invention. FIG. 5B is a schematic cross-sectional view of a via hole area VA, which is taken along the line I-I' of FIG. 5A, according to an embodiment of the present invention.

FIG. 5A is a plan view showing some of the plurality of pixels P arranged in an i-th row. A repair line RLi and a control line CLi extend along the row direction and are adjacent to each other. The repair line RLi extends and overlaps with anodes of the pixels P.

Referring to FIG. 5B, a buffer layer 112 is selectively located (or arranged) on a substrate 111, and an active layer ACT, formed of polysilicon, is disposed on the buffer layer 112. A first insulating layer 113 is disposed on the active layer ACT, and the control line CLi is disposed on the first insulating layer 113. The control line CLi may be an initialization control line GILi. A second insulating layer 114 is located (or arranged) on the control line CLi, and the repair line RLi is located (or arranged) on the second insulating layer 114. A third insulating layer 115 is located (or arranged) on the repair line RLi, and a contact metal CM is located (or arranged) on the third insulating layer 115 so as to contact the active layer ACT exposed by a hole penetrating through the first through third insulating layers 113, 114, and 115. Although not shown in FIG. 5B, an anode contacting the contact metal CM may be disposed on the contact metal CM.

Because the repair line RLi and the control line CLi extend in parallel with each other to be adjacent to each other, and thus, are capacitively coupled to each other. The capacitive coupling between the repair line RLi and the control line CLi may be represented as a first coupling capacitor CC1 that is parasitic and formed between the repair line RLi and the control line CLi. Because the repair line RLi extends between the active layer ACT and the contact metal CM in the via hole area VA so as to overlap at least partially with the active layer ACT and the contact metal CM, the repair line RLi is capacitively coupled to the active layer ACT and the contact metal CM. Such a capacitive coupling may be represented as a second coupling capacitor CC2 that is parasitic and formed between the repair line RLi and the active layer ACT and between the repair line RLi and the contact metal CM. Because the active layer ACT and the contact metal CM in the via hole area VA contact the anode electrode of the pixel P, the second coupling capacitor CC2 in the present specification may be understood as a coupling capacitor that is parasitic and formed between anode electrodes of the pixels P and the repair line RLi.

Figure 6A:
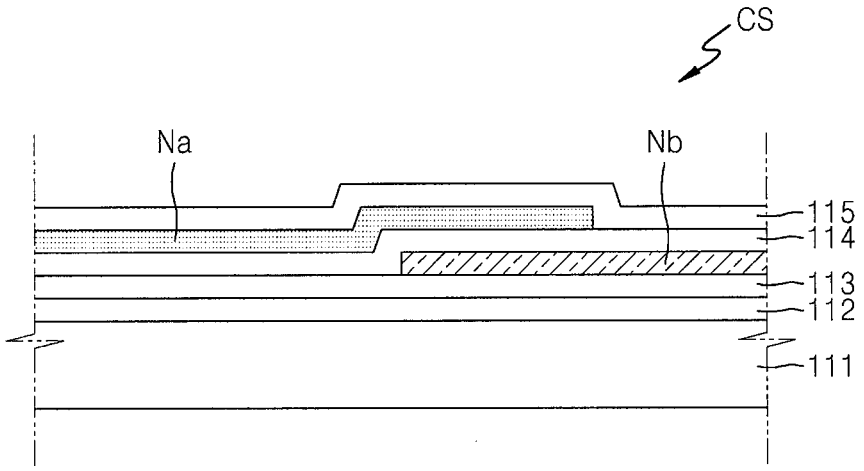
FIG. 6A is a schematic cross-sectional view of a connectable structure used in a display panel, according to an embodiment of the present invention.
Figure 6B:
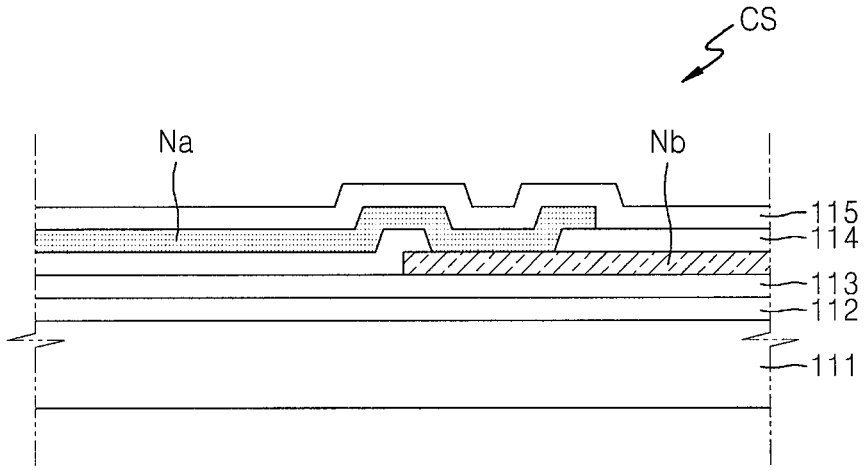
FIG. 6B is a schematic cross-sectional view of a connectable structure functioning as a connection node by irradiating laser to the connectable structure of FIG. 6A, according to an embodiment of the present invention.

FIG. 6A is a schematic cross-sectional view of a connectable structure CS used in a display panel, according to the described embodiment of the present invention. FIG. 6B is a schematic cross-sectional view of the connectable structure CS functioning as a connection node by irradiating a laser to the connectable structure CS of FIG. 6A, according to an embodiment of the present invention.

Referring to FIG. 6A, the connectable structure CS includes first and second conductors Na and Nb that overlap with each other at least partially. The first and second conductors Na and Nb may be electrically insulated from each other by the second insulating layer 114. The first conductor Na is located at the same layer (or same level) as that of the repair line RLi shown in FIG. 5B, and the second conductor Nb may be located at the same layer (or same level) as the control line CLi shown in FIG. 5B. However, the one or more embodiments of the present invention are not limited thereto, and the first and second conductors Na and Nb may be electrically insulated from each other by the first insulating layer 113 or the third insulating layer 115.

When a laser is irradiated to a portion where the first and second conductors Na and Nb overlap with each other in the connectable structure CS, the portion of the second insulating layer 114, where the first and second conductors Na and Nb overlap with each other, is removed, as shown in FIG. 6B, and thus, the second conductor Nb directly contacts the first conductor Na. Accordingly, the first and second conductors Na and Nb are electrically connected to each other, and the connectable structure CS functions as a connection node or a connection line that electrically connects a first member connected to the first conductor Na and a second member connected to the second conductor Nb to each other.

Figure 7:
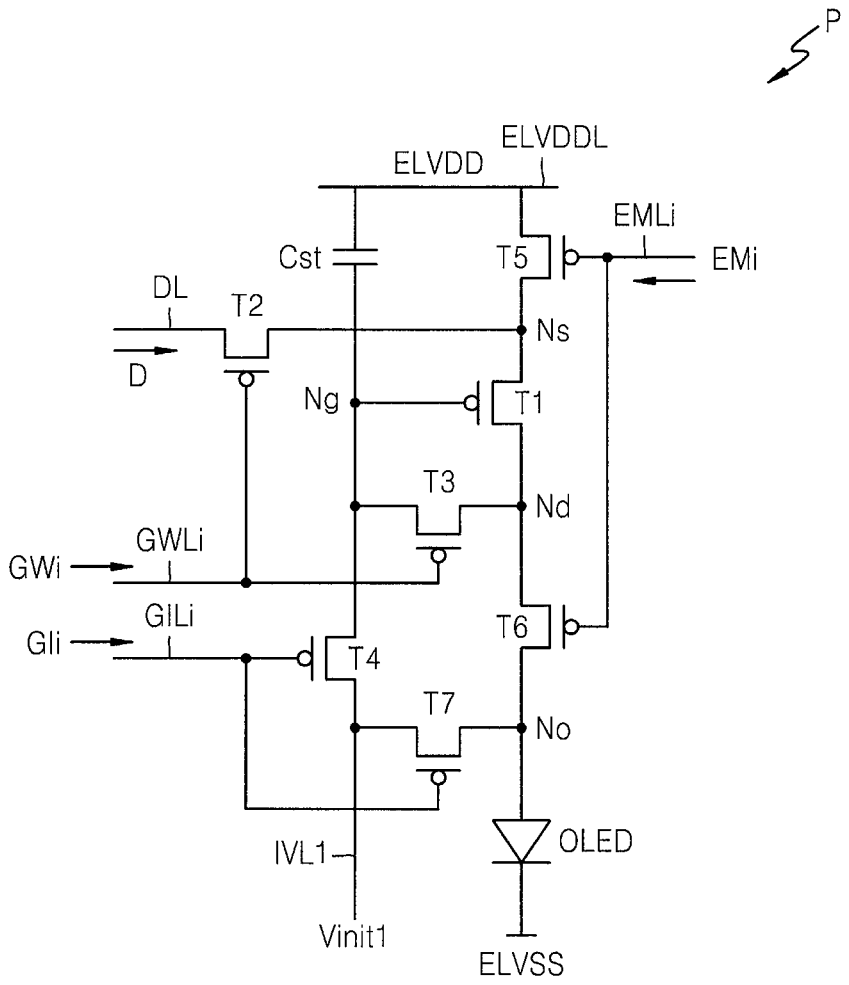
FIG. 7 is a circuit diagram of a pixel in an organic light-emitting display apparatus, according to an embodiment of the present invention.

FIG. 7 is a circuit diagram showing a pixel P in an organic light-emitting display apparatus as an example, according to an embodiment of the present invention.

The pixel P shown in FIG. 7 is one of the plurality of pixels P included in the i-th row and is connected to a scan line GWLi, an initialization control line GILi, and an emission control line EMLi corresponding to the i-th row to receive a scan signal GWi, an initialization control signal Gli, and an emission control signal Emi. The pixel P is connected to a data line DL to receive a data signal D.

The pixel P includes a pixel circuit C, an initialization circuit IC, and a light-emitting device E. The light-emitting device E includes an OLED that is connected to the pixel circuit C to emit light by receiving a driving current supplied from the pixel circuit C. The OLED may include an anode electrode that is also referred to as a pixel electrode, a cathode electrode that is also referred to as an opposite electrode, and an organic emission layer between the anode electrode and the cathode electrode. The anode electrode and the cathode electrode are referred to as an anode terminal and a cathode terminal, respectively. The pixel circuit C may include a driving transistor T1, a switching transistor T2, a compensating transistor T3, a gate initialization transistor T4, a first emission control transistor T5, a second emission control transistor T6, and a capacitor Cst. The initialization circuit IC includes an anode initialization transistor T7.

A gate terminal of the driving transistor T1 is connected to a gate node Ng, a source terminal of the driving transistor T1 is connected to a source node Ns, and a drain terminal of the driving transistor T1 is connected to a drain node Nd. The gate node Ng, the source node Ns, and the drain node Nd may be referred to respectively as a first node, a second node, and a third node. A source-drain current of the driving transistor T1 is determined by a voltage difference between the source node Ns and the gate node Ng and corresponds to a current (e.g., driving current) flowing to the OLED.

A gate terminal of the switching transistor T2 is connected to the scan line GWLi, a first terminal of the switching transistor T2 is connected to the data line DL, and a second terminal of the switching transistor T2 is connected to the source node Ns. The switching transistor T2 is turned on in response to the scan signal GWi provided through the scan line GWLi and transmits the data signal D provided through the data line DL to the source node Ns. The data signal D is transmitted to the gate node Ng of the driving transistor T1 via the compensating transistor T3 that is turned on concurrently (e.g., simultaneously) with the switching transistor T2 in response to the scan signal GWi.

A gate terminal of the compensating transistor T3 is connected to the scan line GWLi, a first terminal of the compensating transistor T3 is connected to the drain node Nd, and a second terminal of the compensating transistor T3 is connected to the gate node Ng. The compensating transistor T3 is turned on in response to the scan signal GWi provided through the scan line GWLi, and the gate terminal and the drain terminal of the driving transistor T1 are connected to each other. When the compensating transistor T3 is turned on the driving transistor T1 is diode-connected, and a threshold voltage Vth of the driving transistor T1 corresponds to a voltage difference between the gate node Ng and the source node Ns.

A gate terminal of the gate initialization transistor T4 is connected to the initialization control line GU, a first terminal of the gate initialization transistor T4 is connected to a first initialization voltage line IVL1, and a second terminal of the gate initialization transistor T4 is connected to the gate node Ng. The gate initialization transistor T4 is turned on in response to the initialization control signal Gli provided through the initialization control line GILi and transmits a first initialization voltage Vinit1 to the gate node Ng to initialize the gate node Ng. The first initialization voltage Vinit1 may be set as the second driving voltage ELVSS or higher.

A gate terminal of the first emission control transistor T5 is connected to the emission control line EMLi, a first terminal of the first emission control transistor T5 is connected to a driving voltage line ELVDDL, and a second terminal of the first emission control transistor T5 is connected to the source node Ns. A gate terminal of the second emission control transistor T6 is connected to the emission control line EMLi, a first terminal of the second emission control transistor T6 is connected to the drain node Nd of the driving transistor T1, and a second terminal of the second emission control transistor T6 is electrically connected to the anode terminal of the OLED. The first and second emission control transistors T5 and T6 are concurrently (e.g., simultaneously) turned on in response to the emission control signal EMi provided via the emission control line EMLi, and the first driving voltage ELVDD is applied to the source terminal of the driving transistor T1 so that the driving current may flow to the OLED.

A gate terminal of the anode initialization transistor T7 is connected to the initialization control line GILi, a first terminal of the anode initialization transistor T7 is connected to the anode terminal of the OLED, and a second terminal of the anode initialization transistor T7 is connected to the first initialization voltage line IVL1. The anode initialization transistor T7 is turned on in response to the initialization control signal Gli provided from the initialization control line GILi and initializes the anode terminal of the OLED.

The capacitor Cst is connected between the driving voltage line ELVDDL and the gate node Ng. The capacitor Cst stores a voltage difference between the first driving voltage ELVDD and a voltage at the gate node Ng.

The anode terminal of the OLED is connectable with the repair line RLi and may be isolated from the output node No. The cathode terminal of the OLED is connected to a second power source applying the second driving voltage ELVSS. The OLED emits light when the OLED receives the driving current from the driving transistor T1 to display images. The first driving voltage ELVDD may be a set or predetermined high level voltage, and the second driving voltage ELVSS may be lower than the first driving voltage ELVDD or a ground voltage.

Hereinafter, processes of operating the pixel P will be described below.

During initialization, the initialization control signal Gli of low level is supplied via the initialization control line GILi, and then the gate initialization transistor T4 and the anode initialization transistor T7 are respectively turned on. The first initialization voltage Vinit1 applied to the first initialization voltage line IVL1 is transmitted to the gate terminal of the driving transistor T1 via the gate initialization transistor T4 and to the anode terminal of the OLED via the anode initialization transistor T7. Accordingly, voltages at the gate terminal of the driving transistor T1 and the anode terminal of the OLED are initialized.

After, during writing data, the scan signal GWi of low level is supplied through the scan line GWLi so that the switching transistor T2 and the compensating transistor T3 are turned on. The switching transistor T2 transfers the data signal D from the data line DL to the source terminal of the driving transistor T1, and the driving transistor T1 is diode-connected by the compensating transistor T3 that is turned on. A compensating voltage that is obtained by subtracting the threshold voltage Vth of the driving transistor T1 from a voltage VD of the data signal D (VD+Vth, Vth has a negative (−) value) is applied to the gate terminal of the driving transistor T1.

The first driving voltage ELVDD and the compensating voltage VD+Vth are applied to opposite terminals of the capacitor Cst, and the capacitor Cst stores an electric charge corresponding to the voltage difference (ELVDD−(VD+Vth)) between the opposite terminals of the capacitor Cst.

After that, during emitting light, the emission control signal EMi provided from the emission control line EMLi is changed from a high level to a low level, and the first emission control transistor T5 and the second emission control transistor T6 are turned on. A driving current is generated according to a voltage difference between a voltage at the gate terminal of the driving transistor T1 and the first driving voltage ELVDD and supplied to the OLED via the second emission control transistor T6. Thus, the OLED emits light by using the driving current.

Figure 8A:
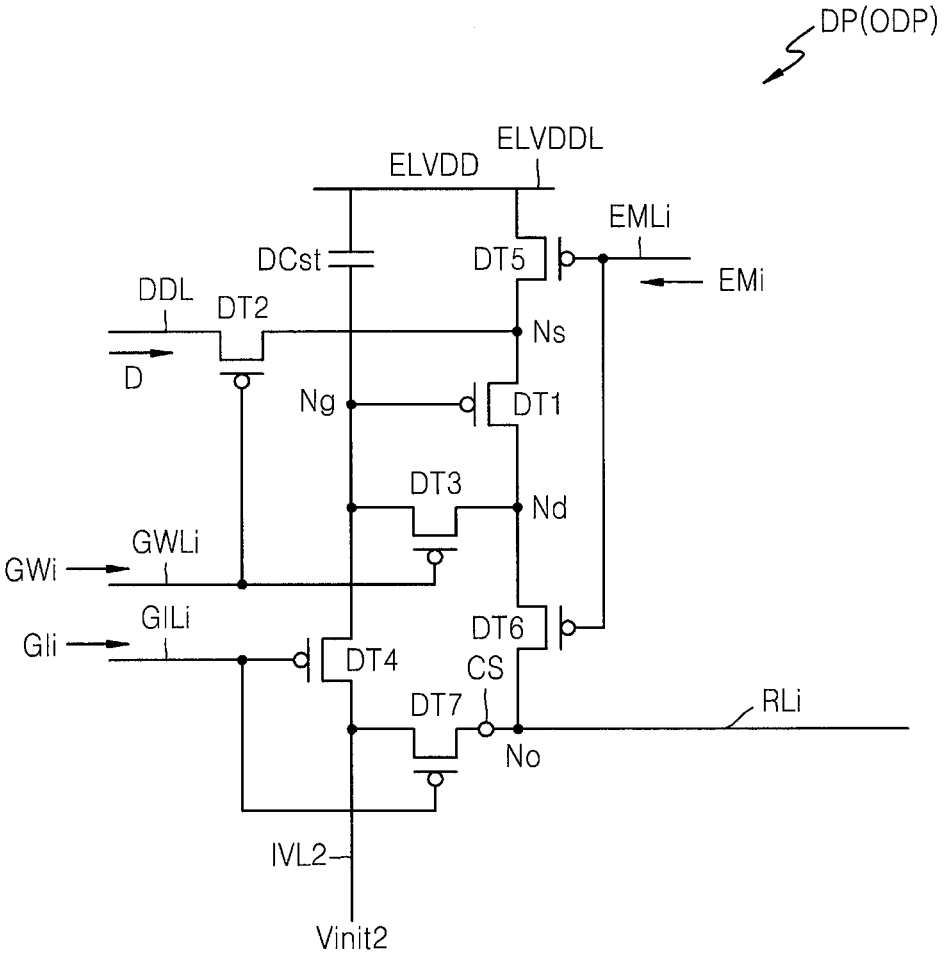
FIG. 8A is a circuit diagram of a dummy pixel in an organic light-emitting display apparatus, according to an embodiment of the present invention.

FIG. 8A is a circuit diagram of a dummy pixel DP in an organic light-emitting display apparatus, according to the described embodiment of the present invention.

The dummy pixel DP shown in FIG. 8A is a dummy pixel located at an i-th row and is an open dummy pixel ODP that is not connected to the light-emitting device E of the pixel P. The dummy pixel DP is connected to the scan line GWLi, the initialization control line Gli, and the emission control line EMLi corresponding to the i-th row to receive an i-th scan signal GWi, an i-th initialization control signal Gli, and an i-th emission control signal EMi.

The dummy pixel DP includes a dummy circuit DC and a dummy initialization circuit DIC. The dummy circuit DC includes a dummy driving transistor DT1, a dummy switching transistor DT2, a dummy compensating transistor DT3, a dummy gate initialization transistor DT4, a first dummy emission control transistor DT5, a second dummy emission control transistor DT6, and a dummy capacitor DCst. The dummy initialization circuit DIC includes a dummy anode initialization transistor DT7.

The dummy circuit DC corresponds to the pixel circuit C, and the dummy initialization circuit DIC corresponds to the initialization circuit IC. Hereinafter, repeated descriptions about components corresponding to those of the pixel P may not be provided and differences from the components of the pixel P will be primarily described below.

Although the first terminal of the switching transistor T2 is connected to the data line DL, a first terminal of the dummy switching transistor DT2 is connected to a dummy data line DDL. In addition, although the first terminal of the gate initialization transistor T4 is connected to the first initialization voltage line IVL1, a first terminal of the dummy gate initialization transistor DT4 is connected to a second initialization voltage line IVL2. While the anode initialization transistor T7 is connected between the first initialization voltage line IVL1 and the output node No, the dummy anode initialization transistor DT7 is connected between the second initialization voltage line IVL2 and the output node No via a connectable structure CS. In FIG. 8A, the connectable structure CS is disposed between the dummy anode initialization transistor DT7 and the output node No; however, the connectable structure CS may be disposed between the dummy anode initialization transistor DT7 and the second initialization voltage line IVL2.

While the output node No of the pixel P is connected to the OLED, an output node No of the dummy pixel DP is connected to a repair line RLi. The second initialization voltage Vinit2 is applied to the second initialization voltage line IVL2, and the level of the second initialization voltage Vinit2 is equal to or less than that of the first initialization voltage Vinit1.

The dummy pixel DP does not include a light-emitting device E. However, the dummy pixel DP may include a light-emitting device E according to the design thereof. If a dummy pixel DP1 includes a light-emitting device E, the light-emitting device E does not emit light, but functions as a circuit device such as a capacitor.

Even if the dummy anode initialization transistor DT7 is turned on in response to the initialization control signal Gli of low level, the second initialization voltage Vinit2 is not applied to the output node No and the repair line RLi due to the connectable structure CS, and, accordingly, the electric potential of the repair line RLi does not drop to the level of the second initialization voltage Vinit2.

Figure 8B:
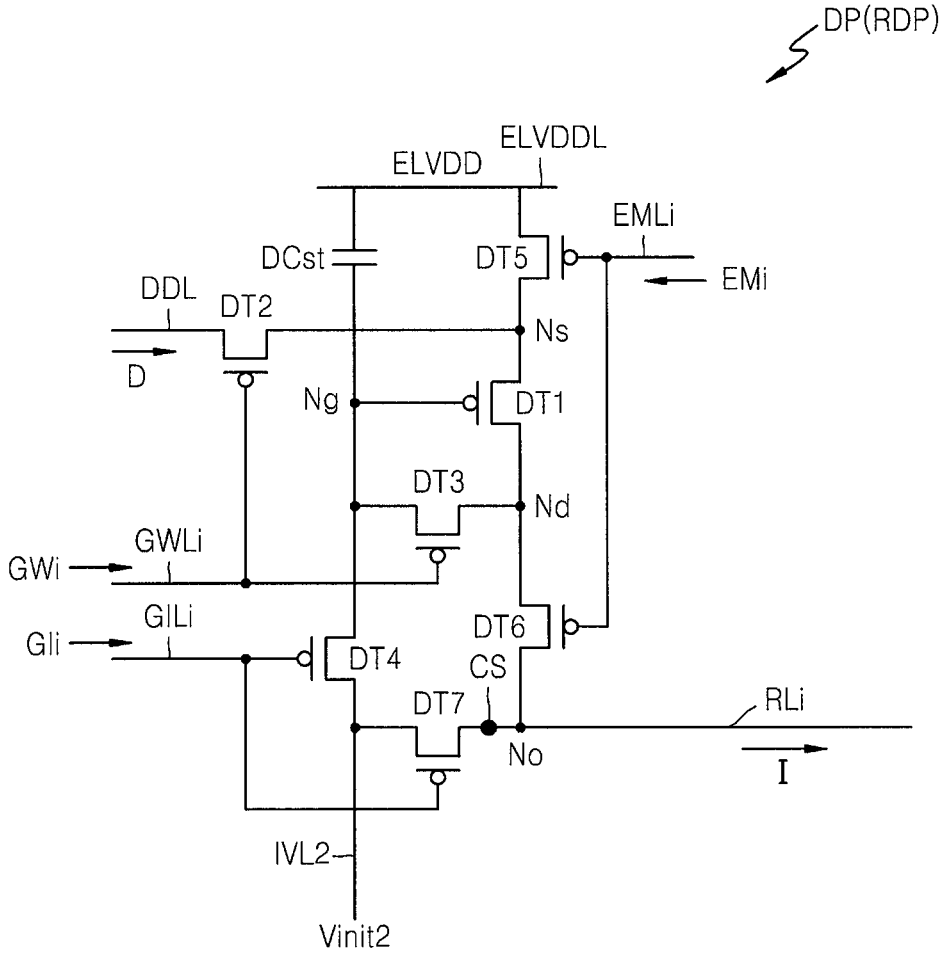
FIG. 8B is a circuit diagram of the dummy pixel of FIG. 8A used as a repair dummy pixel for repairing a defective pixel, according to an embodiment of the present invention.

FIG. 8B is a circuit diagram of the dummy pixel DP of FIG. 8A, which operates as a repair dummy pixel RDP to repair a bad pixel BP, according to an embodiment of the present invention.

Referring to FIG. 8B, a laser is irradiated to the connectable structure CS so that the dummy anode initialization transistor DT7 and the output node No are electrically connected to each other. Even if the dummy anode initialization transistor DT7 is turned on in response to the i-th initialization control signal Gli of low level, the second initialization voltage Vinit2 is applied to the output node No and the repair line RLi.

Because the repair dummy pixel RDP of FIG. 8B is connected to the OLED of the bad pixel BP via the repair line RLi, operations of the repair dummy pixel RDP are the same (or substantially the same) as those of the pixel P shown in FIG. 7, except that the levels of initialization voltages differ. Therefore, operations of the repair dummy pixel RDP are not described here. The repair dummy pixel RDP outputs a driving current I corresponding to the data signal D provided through the dummy data line DDL, and the driving current I is provided to the light-emitting device E of the bad pixel BP via the repair line RLi so that the light-emitting device E emits light due to the driving current I.

Figure 8C:
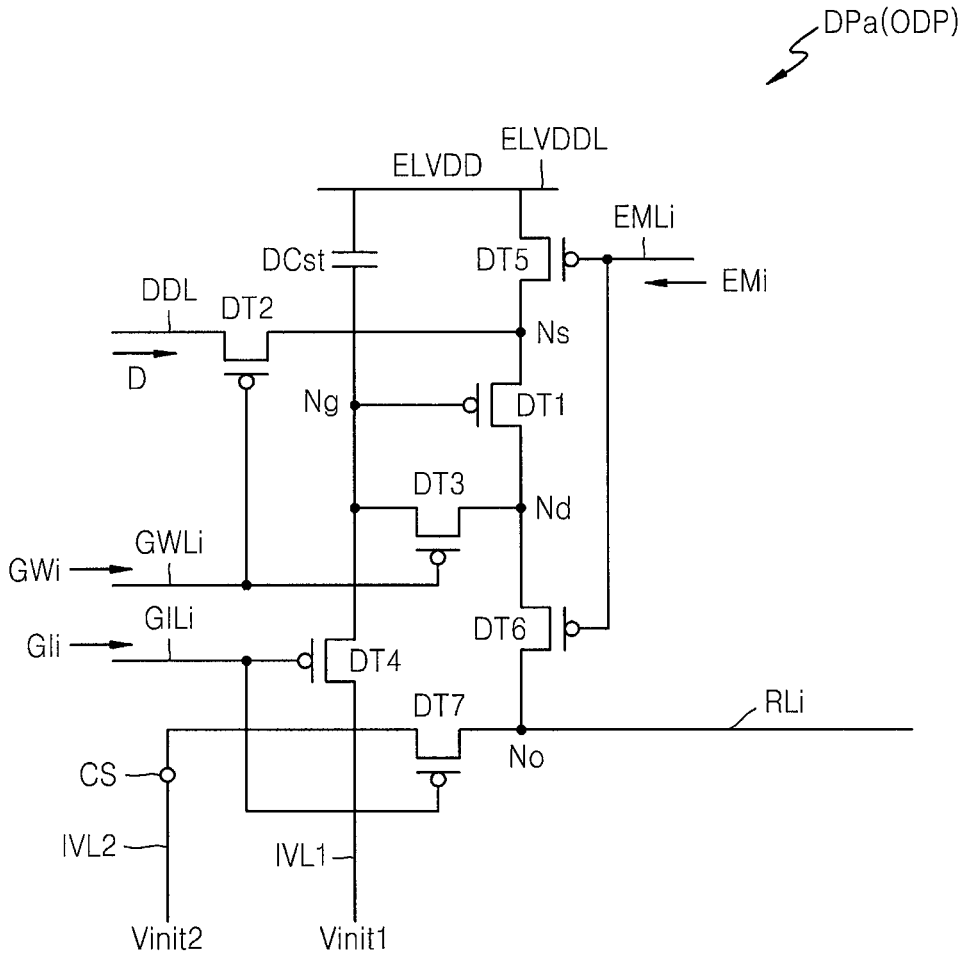
FIG. 8C is a circuit diagram of a dummy pixel in an organic light-emitting display apparatus, according to another embodiment of the present invention.

FIG. 8C is a circuit diagram of a dummy pixel DPa in an organic light-emitting display apparatus, according to another embodiment of the present invention.

Referring to FIG. 8C, the dummy pixel DPa is the same (or substantially the same) as the dummy pixel DP shown in FIG. 8A, except that a first terminal of a dummy gate initialization transistor DT4 is connected to a first initialization line IVL1, like the gate initialization transistor T4 of the pixel P shown in FIG. 7. As described above with reference to FIG. 8A, the connectable structure CS may be located between the dummy anode initialization transistor DT7 and the second initialization voltage line IVL2.

The dummy pixel DPa initializes the gate terminal of the dummy driving transistor DT1 to the first initialization voltage Vinit1 during an initialization period, like the pixel P.

Figure 8D:
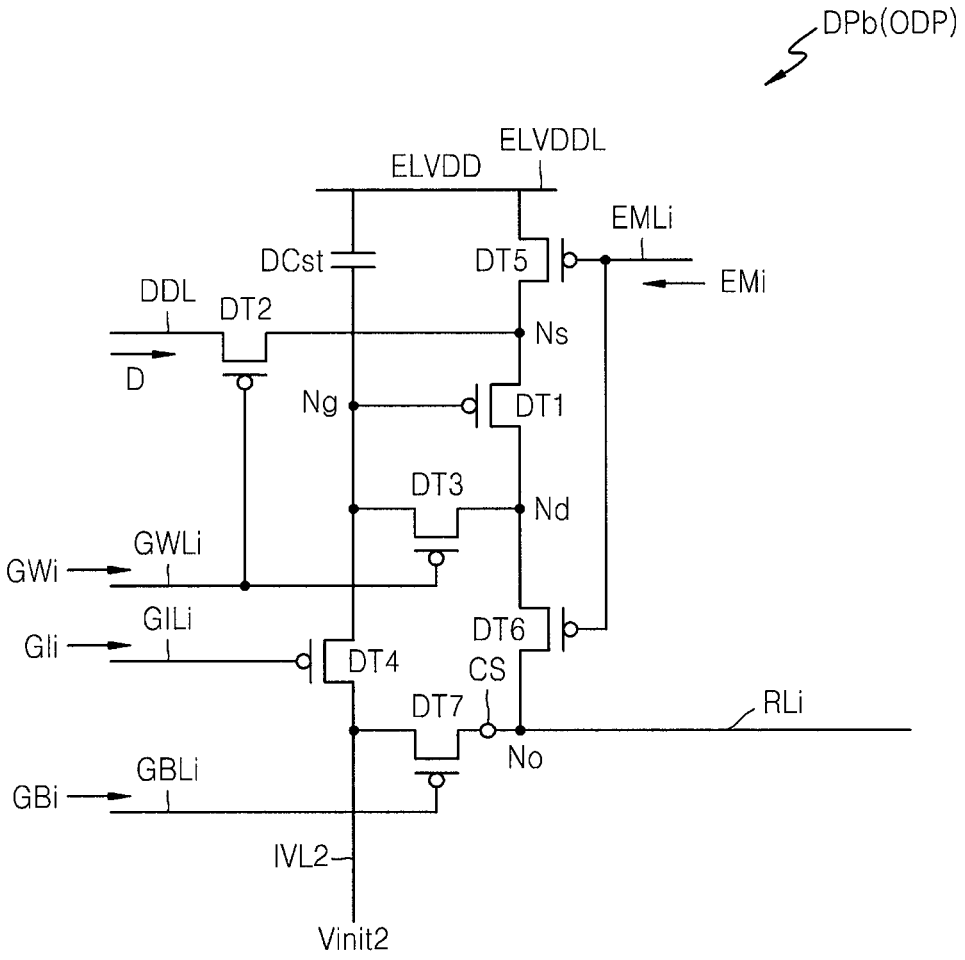
FIG. 8D is a circuit diagram of a dummy pixel in an organic light-emitting display apparatus, according to another embodiment of the present invention.

FIG. 8D is a circuit diagram of a dummy pixel DPb of an organic light-emitting display apparatus, according to another embodiment of the present invention.

Referring to FIG. 8D, the dummy pixel DPb is the same (or substantially the same) as the dummy pixel DP shown in FIG. 8A, except that a gate terminal of a dummy anode initialization transistor DT7 is connected to a gate initialization control line GBLi. The dummy anode initialization transistor DT7 of the dummy pixel DPb is turned on in response to a gate initialization control signal GBi provided via the gate initialization control line GBLi. The gate initialization control signal GBi may be the same (or substantially the same) as the initialization control signal Gli.

According to another embodiment, the gate initialization control signal GBi may be at a low level within a data writing period, in addition to the initialization period. In this case, a phenomenon in which the electric potential of the repair line RLi is boosted when the initialization control signal Gli transits to a high level may be reduced due to the capacitive coupling between the initialization control line GILi and the repair line RLi.

According to another embodiment, the gate initialization control signal GBi may have a low level at a point where the light emission period starts, in addition to the initialization period. In this case, a phenomenon in which the electric potential of the repair line RLi is boosted at the point when the pixels P emit light may be improved due to the capacitive coupling between anode electrodes of the pixels P and the repair line RLi.

Figure 9:
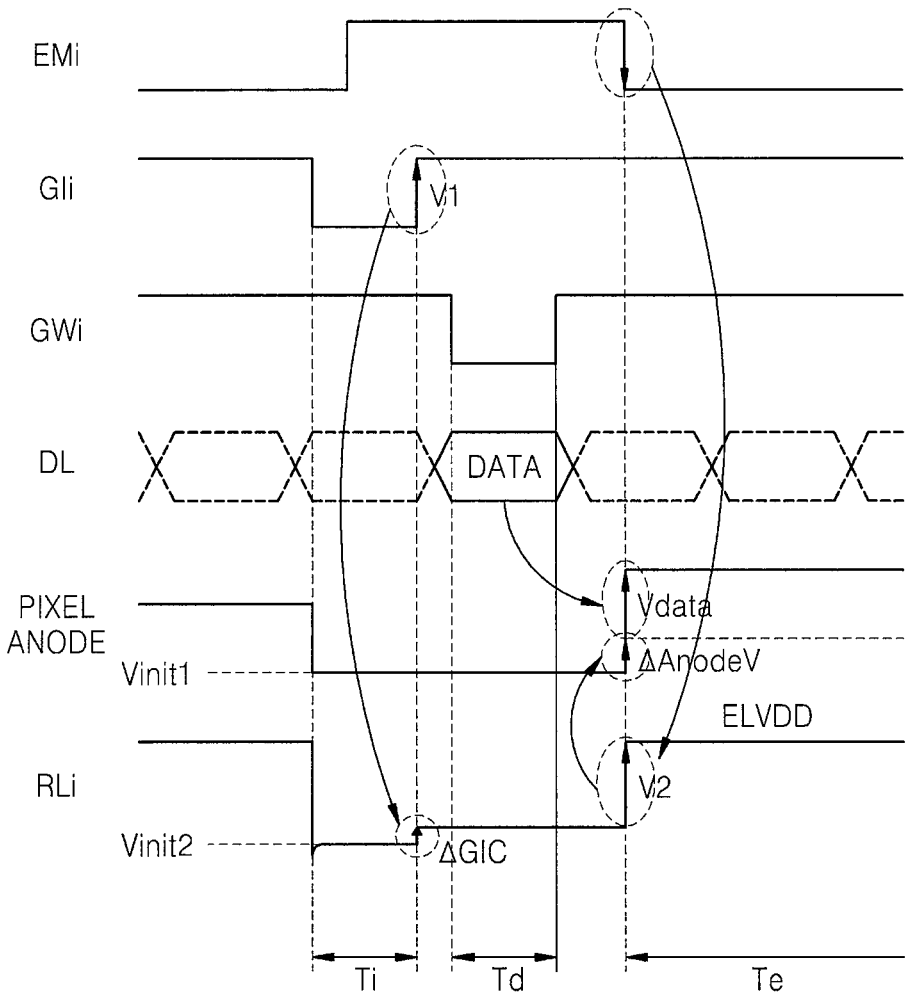
FIG. 9 is a timing diagram of one frame period in an organic light-emitting display apparatus according to a comparative example.

FIG. 9 is a timing diagram of one frame period in an organic light-emitting display apparatus, according to a comparative example.

As described above with reference to FIG. 7, in the normal pixel NP shown in FIG. 1, the gate terminal of the driving transistor T1 and the anode terminal of the OLED are initialized to the first initialization voltage Vinit1 in response to the initialization control signal Gli during the initialization period Ti. A voltage corresponding to the data signal DATA transmitted through the data line DL is stored in the capacitor Cst in response to the scan signal GWi during a data writing period Td. During the light emission period Te, the driving transistor T1 supplies a driving current corresponding to the data signal DATA to the OLED based on the voltage stored in the capacitor Cst, and an electric potential PIXEL ANODE of the anode terminal of the OLED rises as much as a voltage Vdata corresponding to the data signal DATA.

However, if there is no connectable structure CS in the open dummy pixel ODP, that is, if the circuit configuration of the dummy pixel DP is the same as the circuit configuration of the pixel P, the voltage at the anode terminal of the OLED in the pixel P rises by as much as a voltage (ΔAnodeV) due to the rising of the electric potential of the repair line RLi at a point when the emission period Te starts.

For example, in a case of the open dummy pixel ODP of FIG. 1, when all the pixels P in the second sub-active area AAb operate normally, the second dummy data line DDLb floats. In this case, in the open dummy pixel ODP that does not include the connectable structure CS, when the gate terminal of the dummy driving transistor DT1 is initialized to the second initialization voltage Vinit2 during the initialization period Ti, the dummy driving transistor DT1 is fully turned on. Because the second dummy data line DDLb floats during the data writing period Td, the data signal DATA is not transmitted and the dummy driving transistor DT1 is continuously in the fully turned-on state. When the first and second dummy emission control transistors DT5 and DT6 are turned on in the emission period Te, the first and second dummy emission control transistors DT5 and DT6 between the driving voltage line ELVDDL and the output node No and the dummy driving transistor DT1 are all turned on. In addition, as shown in FIG. 9, the electric potentials of the output node No and the repair line RLi connected to the output node No rise largely (by an amount shown as V2) to the level of the first driving voltage ELVDD.

As described above, because the repair line RLi and the anode electrodes of the pixels P are capactively coupled to each other, when the electric potential of the repair line RLi rises largely (by V2) as shown in FIG. 9, the electric potential of the anode terminal of the pixels P may rise as much as a voltage ΔAnodeV, in addition to the voltage Vdata corresponding to the data signal DATA. Accordingly, all the pixels P in the second sub-active area AAb emit light at a luminance that is brighter than a level of the data signal DATA. The rapid rising of the electric potential of the repair line RL at the point when the emission period Te starts to the level of the first driving voltage ELVDD commonly occurs throughout the dummy pixels DP in the second sub-dummy area DAb.

On the contrary, in FIG. 1, the first dummy data line DDLa is electrically connected to the data line DLj. Because the electric potentials of the repair lines RL connected to the dummy pixels DP on the first sub-dummy area DAa only rise as much as a voltage level corresponding to the data signal DATA of the first dummy data line DDLa at the point when the emission period Te starts, the electric potentials of the repair lines RL do not rapidly rise like the repair lines RL connected to the dummy pixels DP on the second sub-dummy area DAb. Therefore, the rising of the electric potential of the anode terminals of the pixels P on the first sub-active area AAa is restricted, and thus, the pixels P do not emit light at the luminance corresponding to the data signal DATA, like the pixels P in the second sub-active area AAb do.

Due to the above problem, there is a brightness difference between the first sub-active area AAa and the second sub-active area AAb and the brightness difference may be recognizable by an observer.

Figure 10:
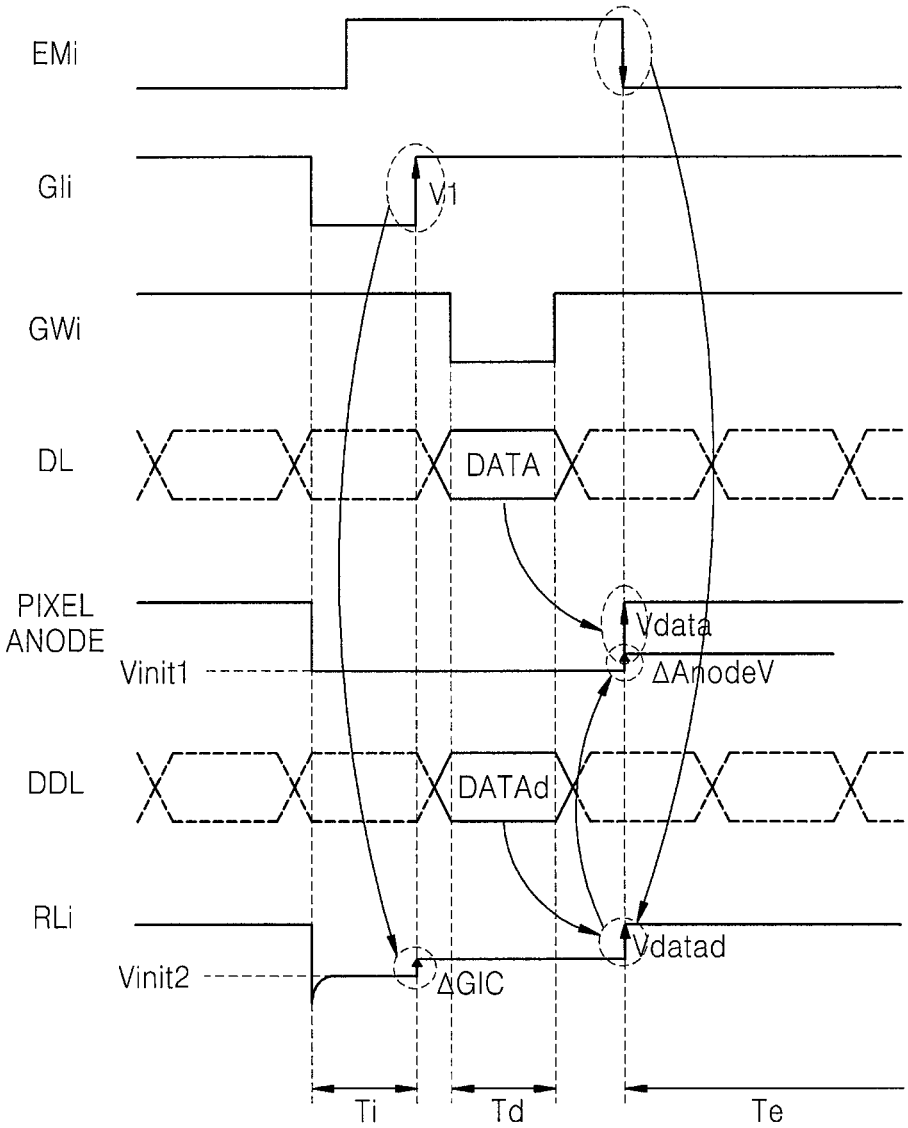
FIG. 10 is a timing diagram of one frame period in an organic light-emitting display apparatus, according to an embodiment of the present invention.

FIG. 10 is a timing diagram of one frame period in an organic light-emitting display apparatus, according to an embodiment of the present invention.

In the organic light-emitting display apparatus of the present embodiment, the repair dummy pixel RDP that is used to repair the bad pixel BP is initialized to the level of the second initialization voltage Vinit2 during the initialization period Ti. The repair dummy pixel RDP receives the data signal DATA from the dummy data line DDL during the data writing period Td and outputs a driving current corresponding to the data signal DATAd to the repair line RLi during the emission period Te. The driving current is output as a second driving power via the OLED of the bad pixel BP, the electric potential of the repair line RLi rises as much as a voltage Vdatad corresponding to the data signal DATAd at a point when the emission period Te starts. The voltage Vdatad is less than the voltage V2 of FIG. 9.

In the organic light-emitting display apparatus of the present embodiment, the repair line RLi and the anode electrode of the pixel P are capacitively coupled to each other, but the potential rising amount (Vdatad) of the repair line RLi is not large. Thus, as shown in FIG. 10, the electric potential of the anode terminal of the pixel P further rises as much as a voltage ΔAnodeV in addition to the voltage Vdata corresponding to the data signal DATA. The voltage ΔAnodeV is a rising voltage due to the capacitive coupling with the repair line RLi in proportional to the potential rising amount Vdatad of the repair line RLi. Therefore, the electric potential PIXEL ANODE of the anode terminals of the pixels P located at the same row as the bad pixel BP further rises as much as the voltage ΔAnodeV in addition to the voltage Vdata corresponding to the data signal DATA at the point when the emission period Te starts. Consequently, because the voltage ΔAnodeV is small, the pixels P located at the same row as the repair dummy pixel RDP emit light with a luminance that actually corresponds to the data signal DATA.

In the organic light-emitting display apparatus of the present embodiment, because the repair line RLi of the open dummy pixel ODP that is not used to repair the bad pixel BP is not initialized during the initialization period Ti, the electric potential does not largely change at the point when the emission period Te starts. In a case where the dummy data line DDL floats, as well as the dummy data line DDL connected to the open dummy pixel ODP that is connected to another data line DL, the repair line RLi connected to the open dummy pixel ODP is not initialized to the second initialization voltage Vinit2, and thus, the electric potential of the repair line RLi does not largely change at a point when the emission period Te starts. Therefore, a rising amount of the electric potential of the anode terminals in the pixels P due to the capacitive coupling is small. Thus, the pixels P located at the same row as the open dummy pixel ODP emit light actually at the luminance corresponding to the data signal DATA.

The pixels P located at the same row as the repair dummy pixel RDP and the pixels P located at the same row as the open dummy pixel ODP are not distinguished from each other.

Figure 11:
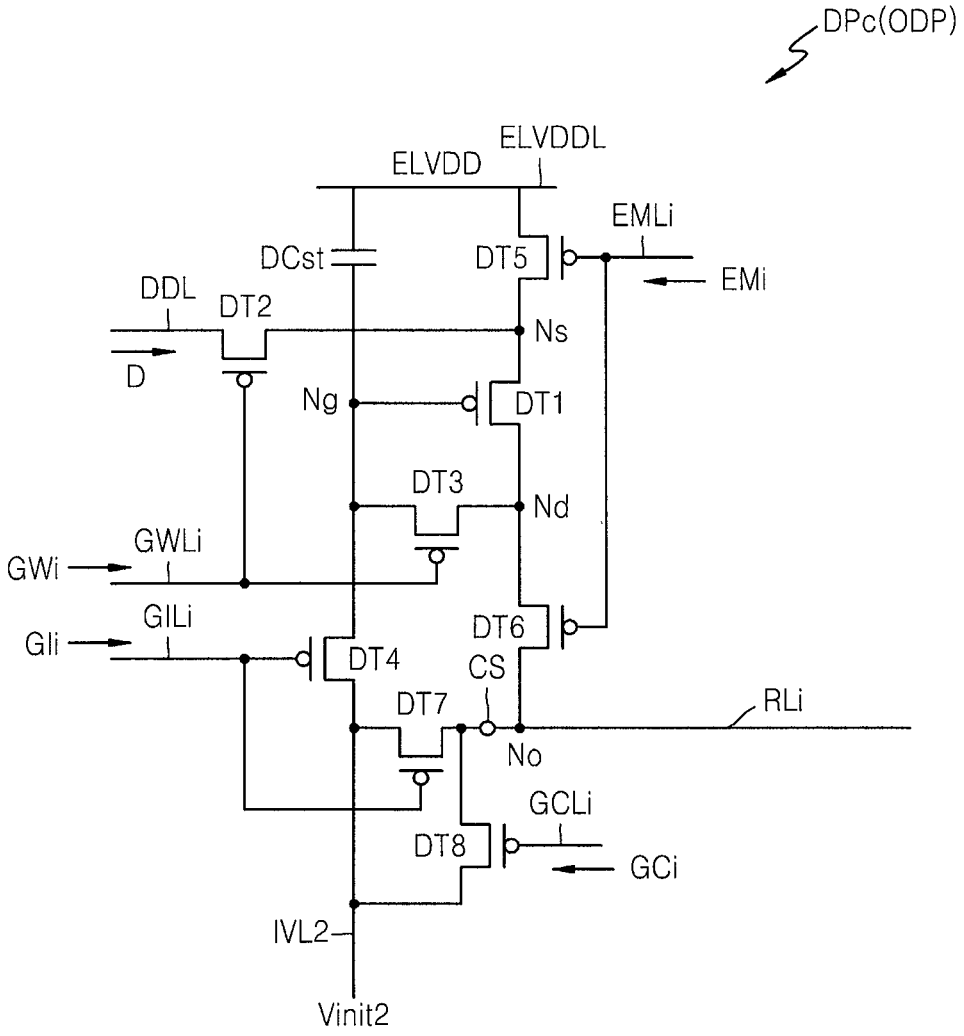
FIG. 11 is a circuit diagram of a dummy pixel in an organic light-emitting display apparatus, according to another embodiment of the present invention.

FIG. 11 is a circuit diagram of a dummy pixel DPc in the organic light-emitting display apparatus, according to another embodiment of the present invention.

Referring to FIG. 11, the dummy pixel DPc is the same (or substantially the same) as the dummy pixel DP shown in FIG. 8A, except that the dummy pixel DPc further includes a coupling removal transistor DT8 that is connected to the dummy anode initialization transistor DT7 in parallel. A gate terminal of the coupling removal transistor DT8 is connected to a coupling removal control line GCLi that transmits a coupling removal control signal GCi, a first terminal of the coupling removal transistor DT8 is connected to the first terminal of the dummy anode initialization transistor DT7, and a second terminal of the coupling removal transistor DT8 is connected to the second terminal of the dummy anode initialization transistor DT7.

In FIG. 11, the coupling removal control line GCLi is shown as a separate control line, but it may be connected to another control line. For example, the coupling removal control line GCLi may be connected to the scan line GWLi. According to another embodiment, the coupling removal control line GCLi may be connected a scan line (e.g., GWLi+1 or GWLi+2) transmitting a scan signal (e.g., GWi+1 or GWi+2) that is one or two scan timings later than the scan signal GWi. The coupling removal control line GCLi may be driven by the gate driver 120, and the coupling removal control signal GCi transmitted through the coupling removal control line GCLi may be the same as the scan signal (e.g., GWi, GWi+1, or GWi+2).

Figure 12:
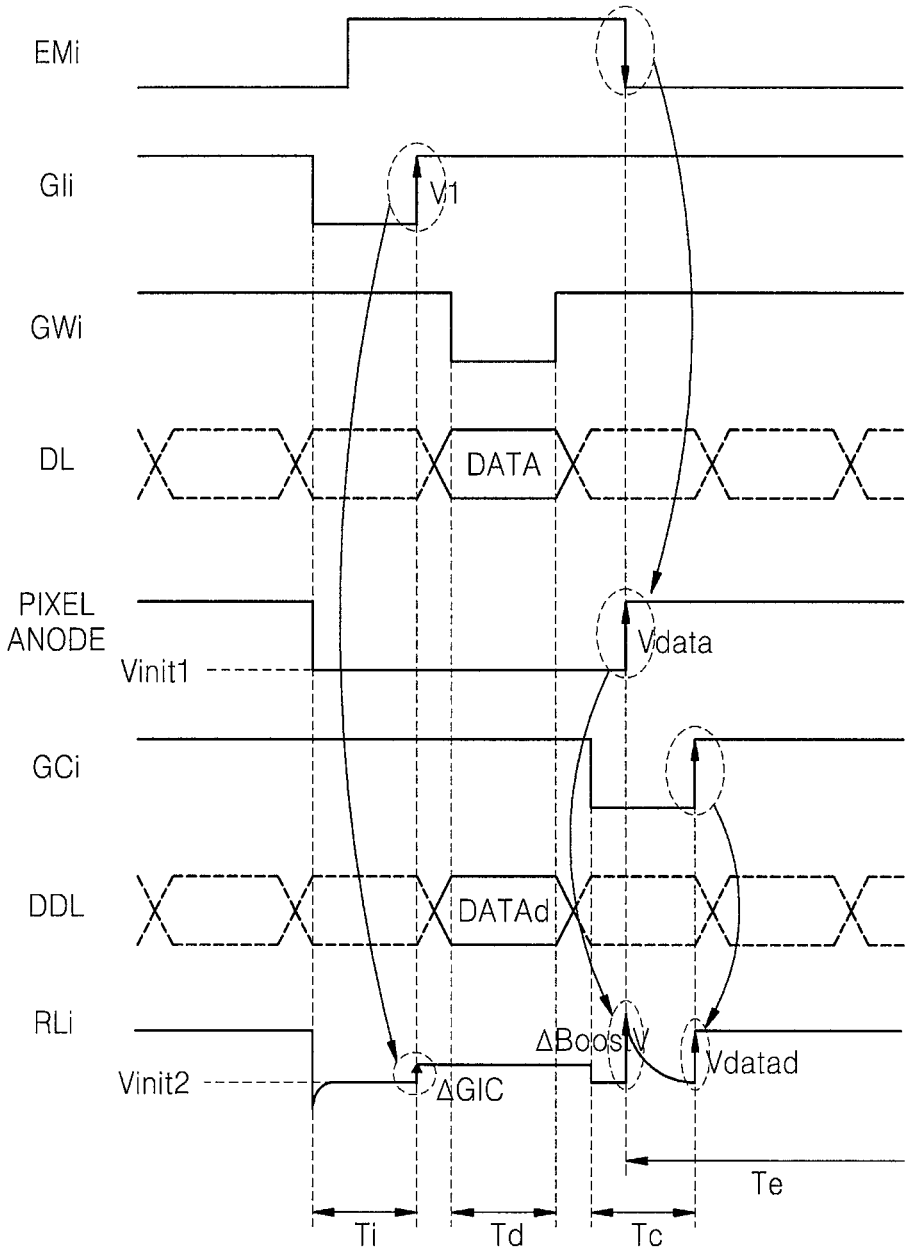
FIG. 12 is a timing diagram of one frame period in the organic light-emitting display apparatus including the dummy pixel of FIG. 11, according to an embodiment of the present invention.

FIG. 12 is a timing diagram of one frame period in the organic light-emitting display apparatus including the dummy pixel DPc of FIG. 11, according to an embodiment of the present invention.

The timing diagram of FIG. 12 shows a case where the coupling removal control signal GCi is the same (or substantially the same) as the scan signal GWi+1.

Referring to FIG. 12, at the time when the initialization period Ti is finished, the initialization control signal Gli has a rising edge and the electric potential of the initialization control line GILi is increased by V1. As described above, because the initialization control line GILi and the repair line RLi are capacitively coupled to each other, the electric potential of the repair line RLi is increased by ΔGIC at the time when the initialization period Ti is finished.

A coupling removal period Tc is defined as a time period in which the coupling removal transistor DT8 is turned on or the coupling removal control signal GCi has a low level. Because the coupling removal transistor DT8 is turned on during the coupling removal period Tc, the second initialization voltage Vinit2 is applied to the repair line RLi. At the time when the coupling removal period Tc starts, the electric potential of the repair line RLi is dropped to the level of the second initialization voltage Vinit2.

At the time when the emission period Te starts, the emission control signal EMi has a falling edge and the electric potential PIXEL ANODE of the anode terminal of the pixel P rises by a voltage Vdata corresponding to the data signal DATA from the data line DL. Here, the coupling removal control signal GCi has a low level, and thus, the coupling removal transistor DT8 is turned on and the second initialization voltage Vinit2 is continuously applied to the repair line RLi. Therefore, the electric potential rising of the anode terminal of the pixel P due to the electric potential rising of the repair line RLi does not occur at the time when the emission period Te starts.

The electric potential PIXEL ANODE of the anode terminal may increase by the voltage Vdata at the time when the emission period Te starts, and accordingly, the electric potential of the repair line RLi may instantly rise by ΔBoost in proportional to the voltage Vdata. However, because the coupling removal transistor DT8 is turned on, the second initialization voltage Vinit2 is applied to the repair line RLi, and accordingly, the electric potential of the repair line RLi is dropped again to the level of the second initialization voltage Vinit2.

At the time when the coupling removal period Tc is finished, the coupling removal transistor DT8 is turned off, and then, the application of the second initialization voltage Vinit2 to the repair line RLi is suspended. The dummy driving transistor DT1 outputs a driving current corresponding to the data signal DATAd of the dummy data line DDL, and the electric potential of the repair line RLi increases by a voltage Vdatad corresponding to the data signal DATAd. The light-emitting device of the pixel P connected to the repair line RLi receives the driving current, and emits light with a luminance corresponding to the data signal DATAd by using the driving current.

By using the coupling removal transistor DT8, a coupling effect (ΔGIC) due to the potential rising of the initialization control line GILi at the time when the initialization period Ti is finished and a coupling effect (ΔBoost) due to the potential rising of the anode terminal of the pixel P at the time when the emission period Te starts may be reduced or prevented. Also, the second initialization voltage Vinit2 is continuously applied to the repair line RLi at the time when the emission period Te starts by using the coupling removal transistor DT8, and thus, the potential rising of the anode terminal of the pixel P, caused by the repair line RLi, does not occur. Therefore, the degradation in image quality due to the capacitive coupling between the repair line RLi, the initialization control line GILi, and the anode electrodes of the pixels P may be reduced.

One of ordinary skill in the art would appreciate that the above coupling removal effect that is the same as or similar to that of the above description may be obtained in a case where the coupling removal control signal GCi is the same as the scan signal GWi or the scan signal GWi+2.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments of the present invention have been described with reference to the figures, it will be understood by those of ordinary skill in the art that various changes in form and details may be made therein without departing from the spirit and scope of the present invention as defined by the following claims and their equivalents.

What is claimed is:

1. An organic light-emitting display apparatus comprising:

a plurality of pixels at an active area;

a plurality of dummy pixels at a dummy area; and a plurality of repair lines coupled to the plurality of dummy pixels and connectable with the plurality of pixels, wherein each of the plurality of dummy pixels comprises:

an output node coupled to a repair line corresponding to the dummy pixel from among the plurality of repair lines;

a dummy circuit comprising a dummy driving transistor that is coupled between a driving voltage line to which a first driving voltage is applied and the output node; and a dummy initialization circuit comprising a dummy anode initialization transistor coupled between a dummy initialization voltage line to which a dummy initialization voltage is applied and the output node via a connectable structure, wherein the connectable structure comprises a first conductor and a second conductor that overlap, at least partially, with each other and are electrically insulated from each other.

2. The organic light-emitting display apparatus of claim 1, wherein when a laser is irradiated to a portion where the first conductor and the second conductor of the connectable structure overlap with each other, the first conductor and the second conductor are electrically coupled to each other.

3. The organic light-emitting display apparatus of claim 1, wherein the plurality of pixels comprises a first pixel comprising a pixel circuit and a light-emitting device that is electrically separated from the pixel circuit, the plurality of repair lines comprises a first repair line that is electrically coupled to the light-emitting device of the first pixel, the plurality of dummy pixels comprises a first dummy pixel that is coupled to the first repair line, a first conductor and a second conductor in a connectable structure of the first dummy pixel are electrically coupled to each other, and when the dummy anode initialization transistor of the first dummy pixel is turned on, the dummy initialization voltage is applied to the first repair line.

4. The organic light-emitting display apparatus of claim 1, wherein the first conductor is electrically coupled to the dummy anode initialization transistor, and the second conductor is electrically coupled to the output node or the dummy initialization voltage line.

5. The organic light-emitting display apparatus of claim 1, further comprising:

a plurality of data lines coupled to the plurality of pixels; and at least one dummy data line coupled to at least some of the plurality of dummy pixels and connectable with at least some of the plurality of data lines.

6. The organic light-emitting display apparatus of claim 5, wherein the active area comprises a first sub-active area and a second sub-active area, the plurality of pixels comprises first pixels at the first sub-active area and second pixels at the second sub-active area, the plurality of dummy pixels comprises first dummy pixels corresponding to the first pixels and second dummy pixels corresponding to the second pixels, the at least one dummy data line comprises a first dummy data line coupled to the first dummy pixels and a second dummy data line coupled to the second dummy pixels, the first dummy data line is connectable with the data lines that are coupled to the first pixels from among the plurality of data lines, and the second dummy data line is connectable with the data lines that are coupled to the second pixels from among the plurality of data lines.

7. The organic light-emitting display apparatus of claim 1, further comprising a plurality of first control lines coupled to the plurality of pixels and the plurality of dummy pixels, wherein each of the plurality of repair lines is capacitively coupled to a corresponding one of the first control lines, which is located at the same row as a corresponding one of the repair lines.

8. The organic light-emitting display apparatus of claim 1, wherein each of the plurality of pixels comprises a pixel circuit and a light-emitting device comprising an anode electrode that is detachably coupled to the pixel circuit, and each of the plurality of repair lines is capacitively coupled to the anode electrodes of the pixels that are located at the same row as that of each of the repair lines.

9. The organic light-emitting display apparatus of claim 1, wherein each of the plurality of pixels comprises:

a pixel circuit configured to receive a data signal and having an output node;

an initialization circuit coupled to the output node; and a light-emitting device that is detachably coupled to the output node, wherein the pixel circuit comprises a driving transistor for supplying a driving current corresponding to the data signal to the output node, and the initialization circuit comprises an anode initialization transistor that is coupled between an initialization voltage line, to which an initialization voltage is applied, and the output node.

10. The organic light-emitting display apparatus of claim 1, further comprising a plurality of control lines that are coupled to the plurality of pixels and the plurality of dummy pixels, wherein the plurality of control lines comprises a plurality of scan lines for transmitting scan signals to the plurality of pixels and the plurality of dummy pixels, a plurality of emission control lines for transmitting emission control signals to the plurality of pixels and the plurality of dummy pixels, and a plurality of initialization control lines for transmitting initialization control signals to the plurality of pixels and the plurality of dummy pixels.

11. The organic light-emitting display apparatus of claim 10, wherein the dummy circuit comprises:

a dummy capacitor coupled between the driving voltage line and a first node;

a dummy switching transistor coupled between a dummy data line for transmitting a data signal and a second node and controlled by the scan signal;

a dummy compensating transistor coupled between the first node and a third node and controlled by the scan signal;

a dummy gate initialization transistor coupled to an initialization voltage line to which an initialization voltage is applied or between the dummy initialization voltage line and the first node and controlled by the initialization control signal;

a first dummy emission control transistor coupled between the driving voltage line and the first node and controlled by the emission control signal;

a second dummy emission control transistor coupled between the third node and the output node and controlled by the emission control signal; and the dummy driving transistor coupled between the second node and the third node and configured to output a driving current corresponding to a difference between a voltage at the first node and a voltage at the second node to the output node.

12. The organic light-emitting display apparatus of claim 11, wherein the initialization voltage line is coupled to the plurality of pixels, and a level of the initialization voltage is higher than a level of the dummy initialization voltage.

13. The organic light-emitting display apparatus of claim 11, wherein the dummy anode initialization transistor is controlled by the initialization control signal.

14. The organic light-emitting display apparatus of claim 13, wherein a frame period comprises:

a first section in which the dummy gate initialization transistor and the dummy anode initialization transistor are in turned on states by the initialization control signal;

a second section in which the dummy switching transistor and the dummy compensating transistor are in turned on states by the scan signal; and a third section in which the first and second dummy emission control transistors are turned on by the emission control signal.

15. The organic light-emitting display apparatus of claim 10, wherein the plurality of control lines further comprises a plurality of anode initialization control lines for transmitting anode initialization control signals to the plurality of pixels and the plurality of dummy pixels, and the dummy anode initialization transistor is controlled by the anode initialization control signals.

16. The organic light-emitting display apparatus of claim 1, wherein each of the plurality of dummy pixels further comprises a coupling removal transistor that is coupled to the dummy anode initialization transistor in parallel, and within one frame period, the coupling removal transistor is turned on later than turning-off of the dummy anode initialization transistor.

17. The organic light-emitting display apparatus of claim 16, wherein the plurality of pixels comprises first pixels located at the same row as a first dummy pixel comprising the coupling removal transistor, and within one frame period, the first pixels emit light earlier than turning-off of the coupling removal transistor in the first dummy pixel.

18. The organic light-emitting display apparatus of claim 17, wherein within one frame period, the first pixels emit light later than turning-on of the coupling removal transistor in the first dummy pixel.

19. The organic light-emitting display apparatus of claim 17, wherein the plurality of pixels comprises a second pixel that is coupled to the first dummy pixel via a first repair line of the repair lines, and when the coupling removal transistor of the first dummy pixel is turned off, a light-emitting device of the second pixel starts to emit light.

20. The organic light-emitting display apparatus of claim 1, wherein the plurality of repair lines comprises a first repair line, the plurality of dummy pixels comprises a first dummy pixel coupled to the first repair line, and a first conductor and a second conductor in a connectable structure of the first dummy pixel are electrically coupled to each other, and when a dummy data line coupled to a dummy circuit of the first dummy pixel floats, the dummy circuit of the first dummy pixel is configured so that an electric potential of a first repair line of the repair lines swings between a level of the first driving voltage and a level of the dummy initialization voltage with one frame period.

* * * * *